US009091995B2

(12) United States Patent
Huang

(10) Patent No.: US 9,091,995 B2
(45) **Date of Patent: *Jul. 28, 2015**

(54) TRANSMISSION DEVICE FOR PHOTOSENSITIVE DRUM AND DRUM DEVICE HAVING SAME

(71) Applicant: GENERAL PLASTIC INDUSTRIAL CO., LTD., Taichung County (TW)

(72) Inventor: Shih-Chieh Huang, Taichung County (TW)

(73) Assignee: GENERAL PLASTIC INDUSTRIAL CO., LTD., Taichung County (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/617,473

(22) Filed: Feb. 9, 2015

(65) Prior Publication Data

US 2015/0153701 A1 Jun. 4, 2015

Related U.S. Application Data

(63) Continuation-in-part of application No. 14/461,011, filed on Aug. 15, 2014, and a continuation-in-part of application No. 14/310,615, filed on Jun. 20, 2014, and a continuation-in-part of application No. 13/965,856, filed on Aug. 13, 2013.

(51) Int. Cl.
*G03G 15/00* (2006.01)
*G03G 21/18* (2006.01)

(52) U.S. Cl.
CPC ..... *G03G 15/757* (2013.01); *G03G 21/1857* (2013.01); *G03G 2221/1657* (2013.01)

(58) Field of Classification Search
CPC ..... G03G 15/757; G03G 21/1857; G03G 2221/1657; G03G 2215/00156
USPC ..... 399/167, 117
See application file for complete search history.

(56) References Cited

U.S. PATENT DOCUMENTS

| | | | | |
|---|---|---|---|---|
| 8,270,876 | B2 * | 9/2012 | Morioka et al. | 399/167 |
| 2011/0182619 | A1 * | 7/2011 | Batori et al. | 399/117 |
| 2011/0217073 | A1 * | 9/2011 | He | 399/111 |
| 2011/0255900 | A1 * | 10/2011 | Zhou et al. | 399/111 |
| 2012/0251175 | A1 * | 10/2012 | Peng et al. | 399/159 |
| 2012/0294649 | A1 * | 11/2012 | Kikuchi et al. | 399/117 |
| 2013/0322923 | A1 * | 12/2013 | Ikeda | 399/117 |

FOREIGN PATENT DOCUMENTS

| | | | |
|---|---|---|---|
| WO | WO 2012113289 | A1 * | 8/2012 |
| WO | WO 2012152203 | A1 * | 11/2012 |

* cited by examiner

*Primary Examiner* — Rodney Bonnette
(74) *Attorney, Agent, or Firm* — Locke Lord LLP; Tim Tingkang Xia, Esq.

(57) ABSTRACT

The invention relates to a transmission device for engagement with a photosensitive drum having a drum axis L, where a sleeve is coaxially coupled to the photosensitive drum. The transmission unit includes a shaft that is rotatable about the drum axis L relative to the sleeve and movable along the drum axis L relative to the sleeve and has a base at one end of the shaft; and at least two engagement blocks extending from two opposite sides of the base away from the drum axis L, where each engagement block is rotatable around a pivotal axis provided at the two opposite sides of the base, and the pivotal axis is perpendicular to the drum axis L. Accordingly, the transmission device can be connected with and separated from the drive member smoothly.

23 Claims, 21 Drawing Sheets

(B)

(A)

TRANSMISSION DEVICE FOR PHOTOSENSITIVE DRUM AND DRUM DEVICE HAVING SAME

CROSS-REFERENCE TO RELATED APPLICATIONS

This application is a continuation-in-part application of U.S. patent application Ser. No. 14/461,011, filed on filed Aug. 15, 2014, entitled "TRANSMISSION DEVICE FOR PHOTOSENSITIVE DRUM", by Shih-Chieh Huang, now allowed, which is hereby incorporated herein in its entirety by reference.

This application also is a continuation-in-part application of U.S. patent application Ser. No. 14/310,615, filed on filed Jun. 20, 2014, entitled "TRANSMISSION DEVICE FOR PHOTOSENSITIVE DRUM", by Shih-Chieh Huang, which is hereby incorporated herein in its entirety by reference.

This application also is a continuation-in-part application of U.S. patent application Ser. No. 13/965,856, filed on Aug. 13, 2013, entitled "TRANSMISSION DEVICE FOR PHOTOSENSITIVE DRUM", by Shih-Chieh Huang, now allowed, which is hereby incorporated herein in its entirety by reference.

Some references, which may include patents, patent applications, and various publications, are cited and discussed in the description of this invention. The citation and/or discussion of such references is provided merely to clarify the description of the present invention and is not an admission that any such reference is "prior art" to the invention described herein. All references cited and discussed in this specification are incorporated herein by reference in their entireties and to the same extent as if each reference was individually incorporated by reference.

FIELD OF THE INVENTION

The present invention relates generally to photosensitive drums mounted in electronic imaging devices, such as printers, copy machines, and so on, and more particularly, to a transmission device for a photosensitive drum and a drum device including the same.

BACKGROUND OF THE INVENTION

The background description provided herein is for the purpose of generally presenting the context of the present invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions. Work of the presently named inventors, to the extent it is described in the background of the invention section, as well as aspects of the description that may not otherwise qualify as prior art at the time of filing, are neither expressly nor impliedly admitted as prior art against the present invention.

A photosensitive drum, which is one of the most important components of an electronic imaging device, is installed in a toner cartridge to conduct electricity when photosensitized and attract carbon powders at the same time to develop the to-be-printed document. A photosensitive drum primarily comprises a photosensitive cylinder and a transmission device attached to an end of the photosensitive cylinder. The transmission device is adapted to be connected with a drive member in a housing of an electronic image forming apparatus to transmit rotatory kinetic energy from the drive member to the photosensitive cylinder.

The conventional transmission device for a photosensitive drum, which comprises a transmission member capable of engagement with the drive member, is usually provided with the design that the transmission member can be pushed by the drive member to swing, such as which disclosed in U.S. Pat. No. 8,295,734, or the design that the transmission member can be pushed by the drive member to move axially, such as which disclosed in Chinese Utility Model Patent No. CN201532527U. By means of the designs, the transmission member is engaged with the drive member when the user puts the toner cartridge into the electronic image forming apparatus and separated from the drive member when the user takes the toner cartridge out of the electronic imaging device.

However, the conventional transmission device for a photosensitive drum, which is provided with a transmission member capable of swinging or moving axially, is complicated in structure so as to be difficult in manufacture and assembly.

Therefore, a heretofore unaddressed need exists in the art to address the aforementioned deficiencies and inadequacies.

SUMMARY OF THE INVENTION

The present invention has been accomplished in view of the above-noted circumstances. It is an objective of the present invention to provide a transmission device for a photosensitive drum, which can be connected with and separated from a drive member of an electronic image forming apparatus in a different way from the conventional ones and is simpler in structure. It is another objective of the present invention to provide a transmission device for a photosensitive drum, which can be connected with a drive member of an electronic image forming apparatus firmly and separated from the drive member smoothly. It is yet another objective of the present invention to provide a drum unit, which can be connected with a drive member of an electronic image forming apparatus firmly and separated from the drive member smoothly.

To attain the above objectives, the present invention provides a drum unit (device), which is adapted for engagement with a drive member of an electronic image forming apparatus provided with two pillars.

In one aspect of the present invention, the drum unit includes a photosensitive drum having a drum axis, L; a shell detachably attached to the photosensitive drum coaxially to the drum axis L; a sleeve coupled with the shell coaxially to the drum axis L; and a transmission unit disposed to the sleeve coaxially to the drum axis L. In one embodiment, the sleeve is integrally formed with the shell coaxially to the drum axis L.

The transmission unit comprises a shaft and at least two engagement blocks. The shaft is rotatable about the drum axis L relative to the sleeve and movable along the drum axis L relative to the sleeve and has a base at one end of the shaft. The at least two engagement blocks extends from two opposite sides of the base away from the drum axis L, such that each engagement block is rotatable around a pivotal axis provided at the two opposite sides of the base, where the pivotal axis is perpendicular to the drum axis L.

In one embodiment, the base has at least two notched receptacles defined in the two opposite sides of the base, where each engagement block is pivotally retained in a respective notched receptacle such that each engagement block is rotatable around the pivotal axis.

In one embodiment, each engagement block has a bottom member, an engagement claw upwards extending from the bottom member, and a through hole defined such that, as assembled, the through hole is coincident with the pivotal axis. In one embodiment, each engagement block is pivotally attached to the base by a pin inserted through the through hole.

In one embodiment, the shaft comprises a first part and a second part, each part comprising a semi-cylindrical body, and a base portion attached to one end of the semi-cylindrical body. The semi-cylindrical bodies of the first and second parts are detachably attachable to each other.

In one embodiment, each semi-cylindrical body has at least one protrusion protruded from a plane surface of the semi-cylindrical body, and at least one recess recessed from the plane surface of the semi-cylindrical body. As assembled, the at least one protrusion of the semi-cylindrical body of the first part is received in the at least one recess of the semi-cylindrical body of the second part, and the at least one protrusion of the semi-cylindrical body of the second part is received in the at least one recess of the semi-cylindrical body of the first part.

In one embodiment, each base portion has two pins extending towards the at least two notched receptacles, respectively, such that, as assembled, each pin is coincident with the pivotal axis. In one embodiment, each engagement block has a bottom member, an engagement claw upwards extending from the bottom member, and two holes oppositely defined such that, as assembled, the pins of the base portions are received in the two holes of each engagement block.

In one embodiment, each base portion has two holes defined facing the at least two notched receptacles, respectively, such that, as assembled, each hole is coincident with the pivotal axis. In one embodiment, each engagement block has a bottom member, an engagement claw upwards extending from the bottom member, and two pins oppositely protruded such that, as assembled, the two pins of each engagement block are received in the corresponding holes of the base portions.

In another aspect, the present invention relates to a transmission unit (device) for engagement with a photosensitive drum having a drum axis L, where a sleeve is coaxially coupled to the photosensitive drum. In one embodiment, the transmission unit comprises a shaft that is rotatable about the drum axis L relative to the sleeve and movable along the drum axis L relative to the sleeve and has a base at one end of the shaft; and at least two engagement blocks extending from two opposite sides of the base away from the drum axis L, where each engagement block is rotatable around a pivotal axis provided at the two opposite sides of the base, and the pivotal axis is perpendicular to the drum axis L.

In one embodiment, the base has at least two notched receptacles defined in the two opposite sides of the base, where each engagement block is pivotally retained in a respective notched receptacle such that each engagement block is rotatable around the pivotal axis.

In one embodiment, each engagement block has a bottom member, an engagement claw upwards extending from the bottom member, and a through hole defined such that, as assembled, the through hole is coincident with the pivotal axis. In one embodiment, each engagement block is pivotally attached to the base by a pin inserted through the through hole.

In one embodiment, the shaft comprises a first part and a second part, each part comprising a semi-cylindrical body, and a base portion attached to one end of the semi-cylindrical body. The semi-cylindrical bodies of the first and second parts are detachably attachable to each other.

In one embodiment, each semi-cylindrical body has at least one protrusion protruded from a plane surface of the semi-cylindrical body, and at least one recess recessed from the plane surface of the semi-cylindrical body. As assembled, the at least one protrusion of the semi-cylindrical body of the first part is received in the at least one recess of the semi-cylindrical body of the second part), and the at least one protrusion of the semi-cylindrical body of the second part is received in the at least one recess of the semi-cylindrical body of the first part.

In one embodiment, each base portion has two pins extending towards the at least two notched receptacles, respectively, such that, as assembled, each pin is coincident with the pivotal axis. In one embodiment, each engagement block has a bottom member, an engagement claw upwards extending from the bottom member, and two holes oppositely defined such that, as assembled, the pins of the base portions are received in the two holes of each engagement block.

In one embodiment, each base portion has two holes defined facing the at least two notched receptacles, respectively, such that, as assembled, each hole is coincident with the pivotal axis. In one embodiment, each engagement block has a bottom member, an engagement claw upwards extending from the bottom member, and two pins oppositely protruded such that, as assembled, the two pins of each engagement block are received in the corresponding holes of the base portions.

As a result, the transmission device for a photosensitive drum provided by the present invention is simpler in structure than the conventional ones, where the engagement blocks can be engaged with the pillars of the drive member of the electronic image forming apparatus so that the transmission device can be driven to rotate. Besides, when the user is going to connect the transmission device with the drive member of the electronic image forming apparatus or separate the transmission device from the drive member of the electronic imaging device, the engagement structure will be pushed by the drive member of the electronic image forming apparatus so that the transmission unit will move axially along the sleeve. At the same time, the protrusion of the shaft will be guided by the guiding grooves of the sleeve so that the transmission unit will rotate. As a result, the transmission unit can be connected with the drive member of the electronic image forming apparatus firmly and separated from the drive member smoothly by moving and rotating at the same time.

These and other aspects of the present invention will become apparent from the following description of the embodiment taken in conjunction with the following drawings, although variations and modifications therein may be affected without departing from the spirit and scope of the novel concepts of the present invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
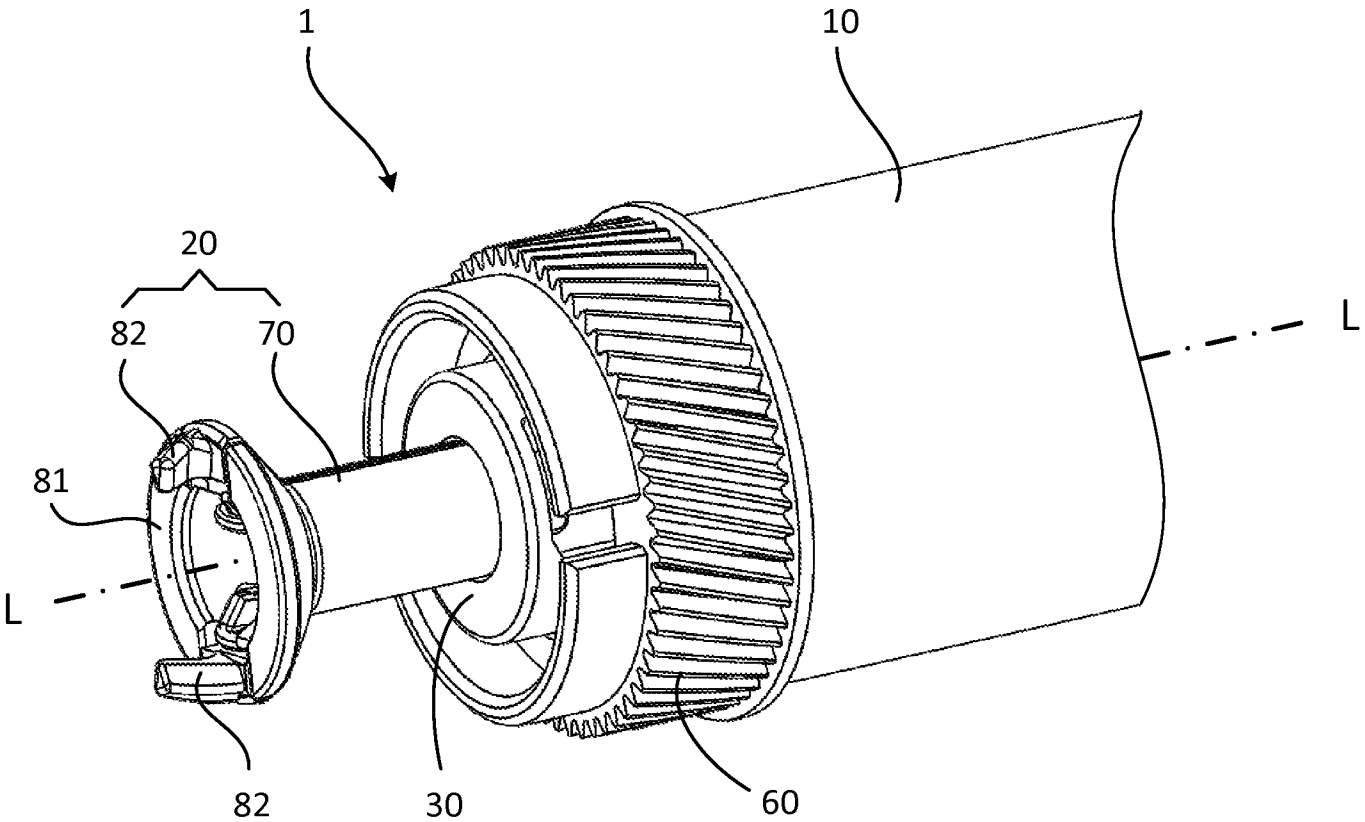
FIG. 1 shows schematically a perspective view of a drum device (unit) according to one embodiment of the present invention.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this invention will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting and/or capital letters has no influence on the scope and meaning of a term; the scope and meaning of a term are the same, in the same context, whether or not it is highlighted and/or in capital letters. It will be appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the present invention.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", or "includes" and/or "including" or "has" and/or "having" when used in this specification specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top", may be used herein to describe one element's relationship to another element as illustrated in the FIGS. It will be understood that relative terms are intended to encompass different orientations of the device in addition to the orientation shown in the FIGS. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present invention, and will not be interpreted in an idealized or overly formal sense unless expressly so defined herein.

As used herein, "around", "about", "substantially" or "approximately" shall generally mean within 20 percent, preferably within 10 percent, and more preferably within 5 percent of a given value or range. Numerical quantities given herein are approximate, meaning that the terms "around", "about", "substantially" or "approximately" can be inferred if not expressly stated.

As used herein, the terms "comprise" or "comprising", "include" or "including", "carry" or "carrying", "has/have" or "having", "contain" or "containing", "involve" or "involving" and the like are to be understood to be open-ended, i.e., to mean including but not limited to.

As used herein, the phrase "at least one of A, B, and C" should be construed to mean a logical (A or B or C), using a non-exclusive logical OR. It should be understood that one or more steps within a method may be executed in different order (or concurrently) without altering the principles of the invention.

The description is now made as to the embodiments of the present invention in conjunction with the accompanying drawings. In accordance with the purposes of this invention, as embodied and broadly described herein, this invention relates to a drum unit having a transmission device for a photosensitive drum engaged with electronic imaging devices, such as printers, copy machines, and so on.

FIG. 1 shows schematically a perspective view of a drum unit (device) according to one embodiment of the present invention. The drum unit includes a photosensitive drum 10 having a drum axis, L, and a transmission device 1 detachably attached to the photosensitive drum 10 coaxially to the drum axis L. The transmission device 1 is used to receive a rotational driving force from a driving mechanism of an electronic imaging device and transmit the rotational driving force to the photosensitive drum 10. The photosensitive drum 10 in turn rotates around its axis L under the rotational driving force.

In this exemplary embodiment, the transmission device 1 includes a shell 60 detachably attached to one end of the photosensitive drum 10 coaxially to the drum axis L, a sleeve 30 coupled with the shell 60 coaxially to the drum axis L, and a transmission unit 20 disposed to the sleeve coaxially to the drum axis L. In one embodiment, the sleeve 30 is integrally formed with the shell 60 coaxially to the drum axis L. The transmission unit 20 comprises a shaft 70, a base 81, and at least two engagement blocks 82. The shaft 70 is rotatable about the drum axis L relative to the sleeve 30 and movable along the drum axis L relative to the sleeve 30. The base 81 is extended from one end of the shaft 70 integrally. The at least two engagement blocks 82 extends from two opposite sides of the base 81 away from the drum axis L, such that each engagement block 82 is rotatable around a pivotal axis provided at the two opposite sides of the base 81, where the pivotal axis is perpendicular to the drum axis L.

Various embodiments of the transmission device of the present invention are described in detail as follows.

Figure 2A:
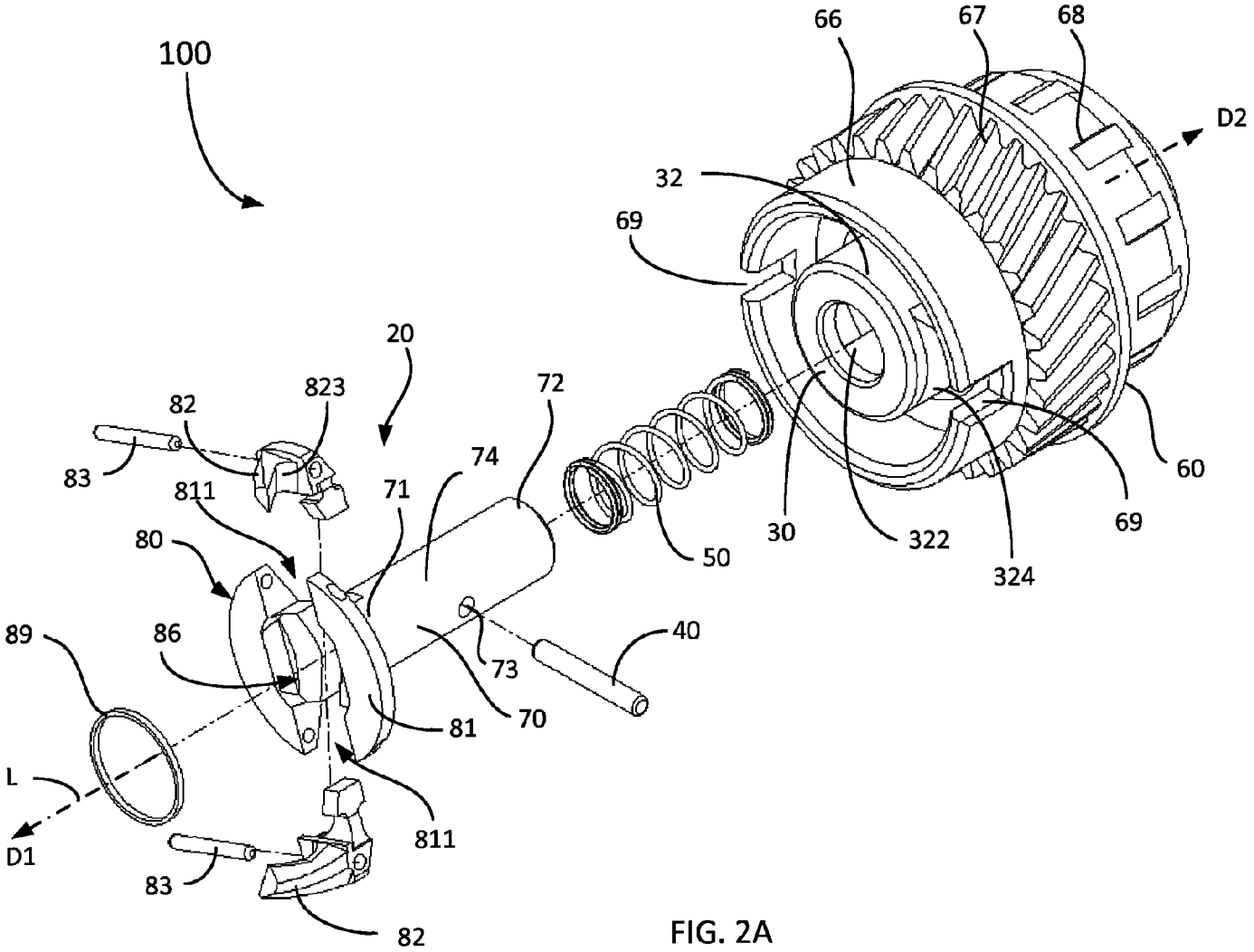
FIG. 2A shows an exploded perspective view of a transmission device utilized in a drum device according to one embodiment of the present invention.
Figure 2B:
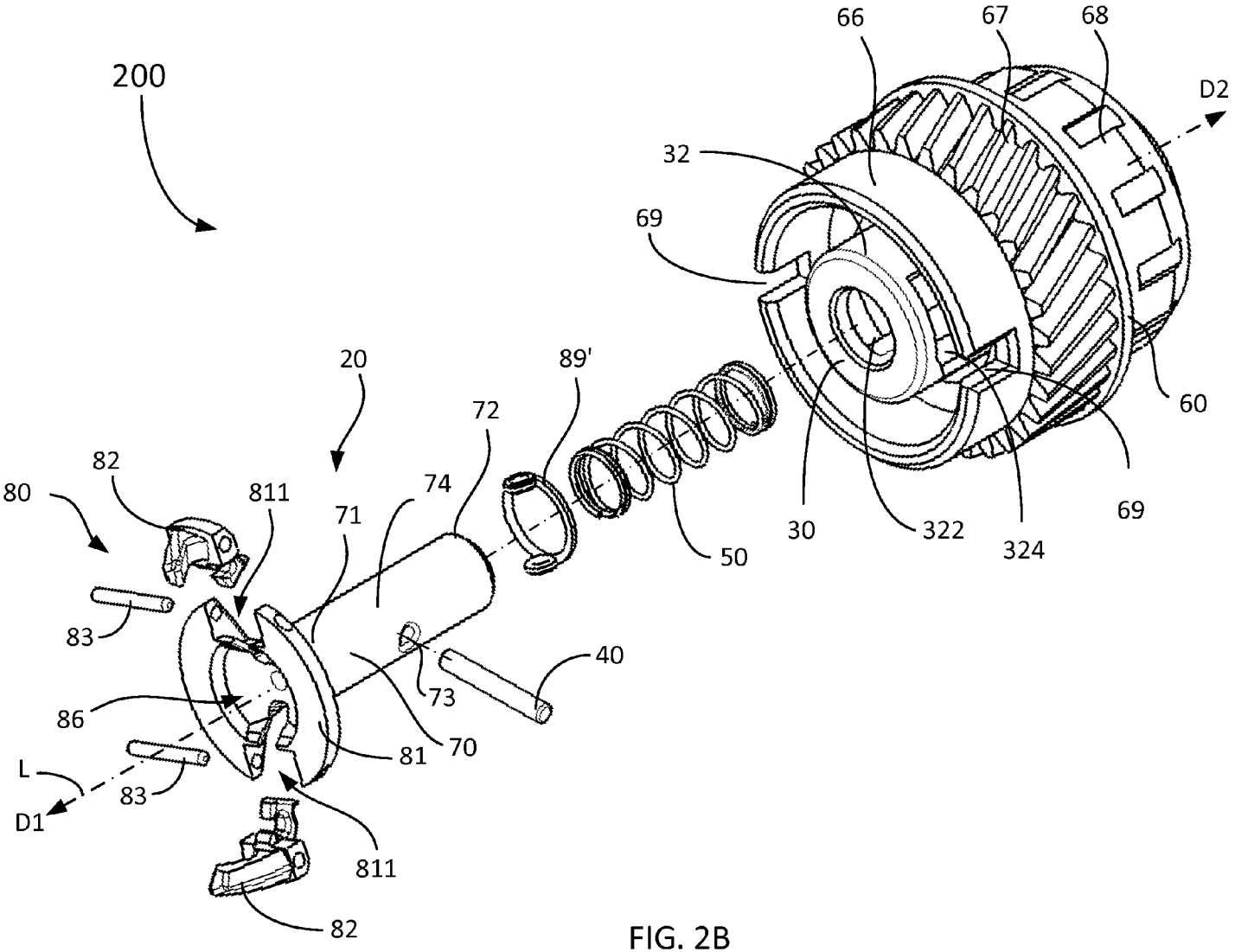
FIG. 2B shows an exploded perspective view of a transmission device utilized in a drum device according to another embodiment of the present invention.

Referring to FIG. 2A, a transmission device 100, which is provided by one embodiment of the present invention, comprises a transmission unit 20, a sleeve 30, an elastic member 50, and a gear member (shell) 60. FIG. 2B shows another embodiment of a transmission device 200, which is essentially the same as the transmission device 100 shown in FIG. 2A, except that the elastic holding member 89 utilized in the transmission device 100 is different from that (89') of the transmission device 200.

As shown in FIGS. 2A, 2B and 4-10, the transmission unit 20 comprises a shaft 70 and an engagement structure 80. The shaft 70 comprises a cylindrical shaft body 74 and at least one protrusion 75 extending along a radial direction of the cylindrical shaft body 74. The shaft body 74 is an elongated element extending along the drum axis L and provided with a first end 71 facing toward a first direction D1, a second end 72 facing toward a second direction D2 opposite to the first direction D1, and an opening 73 penetrating through the main portion of the shaft body 74 along its radial direction. In one embodiment, a pin 40 is inserted into the opening 73 when assembled, where the protrusion 75 is a part of the pin 40 sticking out of the opening 73.

The engagement structure 80 comprises a base 81 extending from the first end 71 of the shaft 70 integrally, and a notched receptacle 811 defined in the base 81. The base 81 has two pairs of holes 812 defined in communication with the notched receptacle 811.

Figure 4:
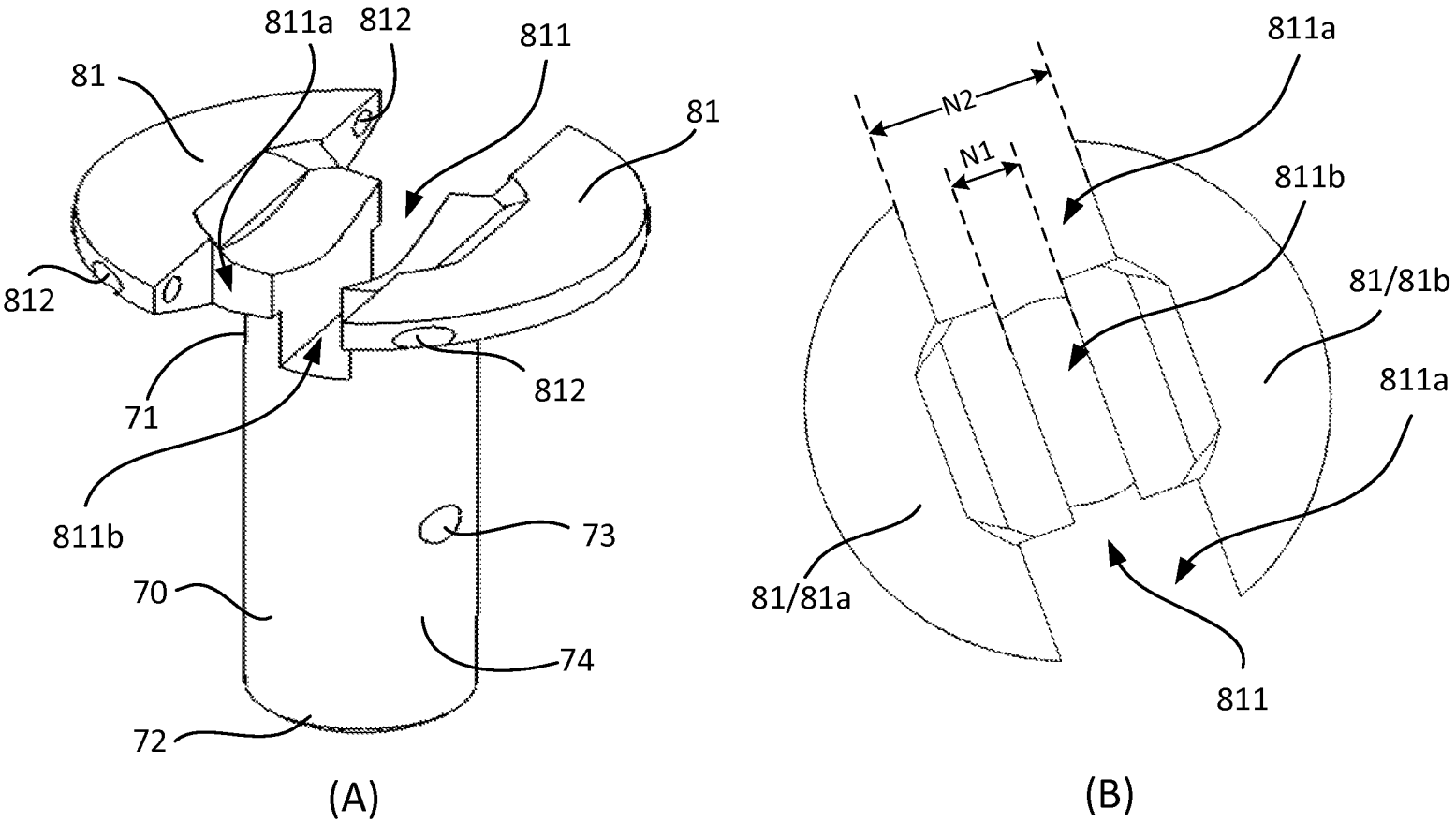
FIG. 4 shows partially a transmission unit utilized in a transmission device according to one embodiment of the present invention, (A) a perspective view, and (B) a top view.
Figure 7:
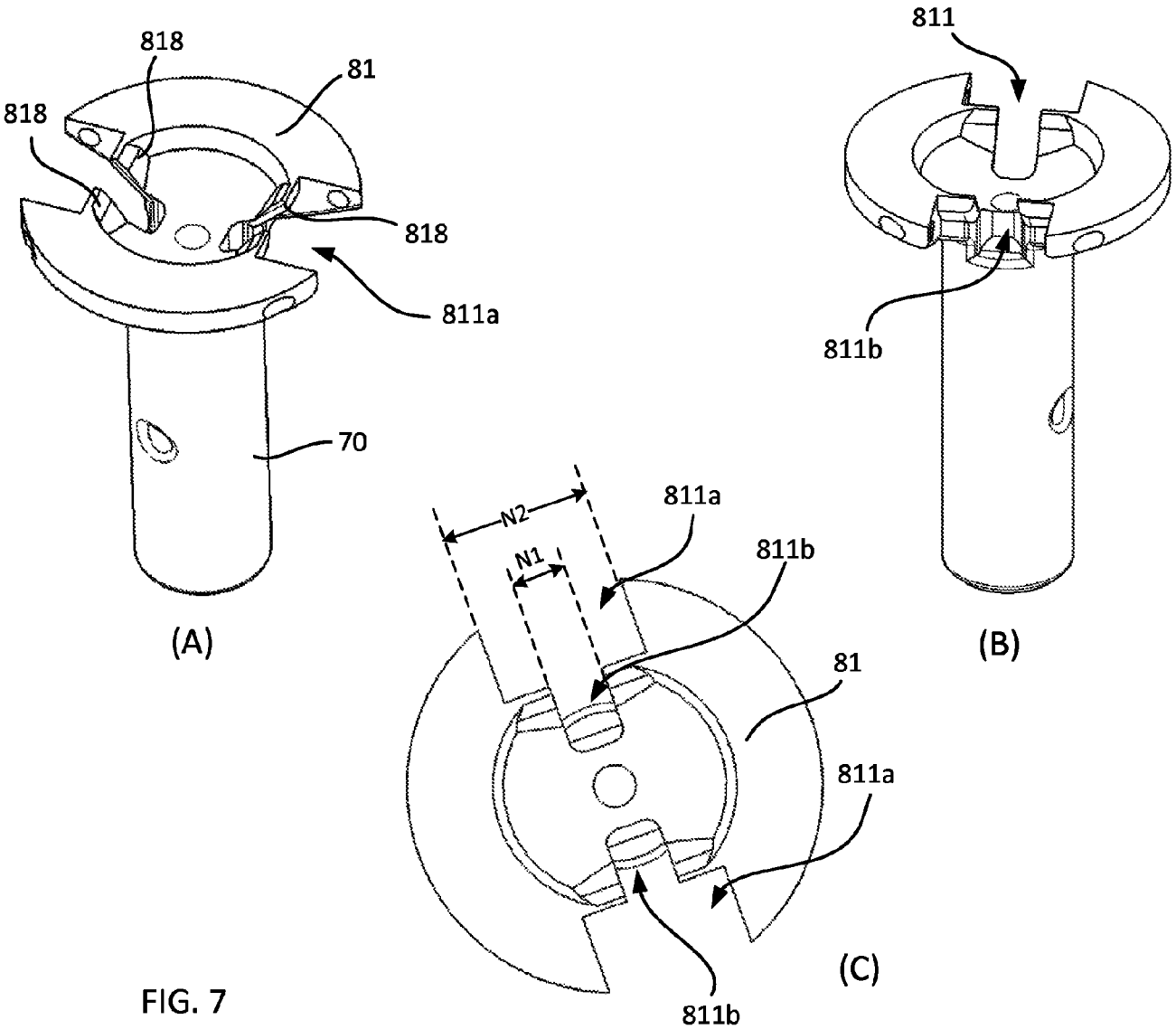
FIG. 7 shows partially a transmission unit utilized in a transmission device according to another embodiment of the present invention, (A) a perspective view, (B) another perspective view, and (C) a top view.

As shown in FIGS. 4 and 7, the notched receptacle 811 has two openings 811*a* defined symmetrically in two opposite sides of the base 81, and two grooves 811*b*, as shown in FIG. 7, defined recessively in the base 81 and the first end portion 71 of the shaft 70 and being in communication with the two openings 811*a*, respectively. Each groove 811*b* has a width, N1, and each opening 811*a* has a width, N2, where the width N1 of each groove 811*b* is narrower than the width N2 of each opening 811*a*. In one embodiment, as shown in FIG. 7, the notched receptacle 811 is defined with barriers 818 that are adapted to prevent an engagement block 82 from over-rotating toward the drum axis L in operation. In addition, the two grooves 811*b* may be formed in the form of one groove, which separates the base 811 into two portions 81*a* and 81*b*, as shown in FIG. 4.

The engagement structure 80 also comprises two engagement blocks 82. In this exemplary embodiment, the engagement blocks 82 are L-shaped. Other types of the engagement blocks can also be utilized to practice the present invention. Each engagement block 82 has a bottom member 829 and an engagement claw 820. The bottom member 829 has a first end portion 829*a* defining a hook 826 and an opposite, second end portion 829*b*. The engagement claw 820 extends upwards (or vertically) from the second end portion 829*b* of the bottom member 829. The two engagement blocks 82 are pivotally received in two opposite sides of the notched receptacle 811, respectively, such that each engagement block 82 is rotatable around a pivotal axis at the second end portion 829*b* of the bottom member 829, the pivotal axis being perpendicular to the drum axis L, the first end portion 829*a* of the bottom member 829 is toward the drum axis L and the engagement claw 820 is helically toward the first direction D1 in a normal state. The two engagement blocks 82 define a receiving space 86 therebetween for receiving a drive member (driving mechanism) of an electronic imaging device.

Figure 5:
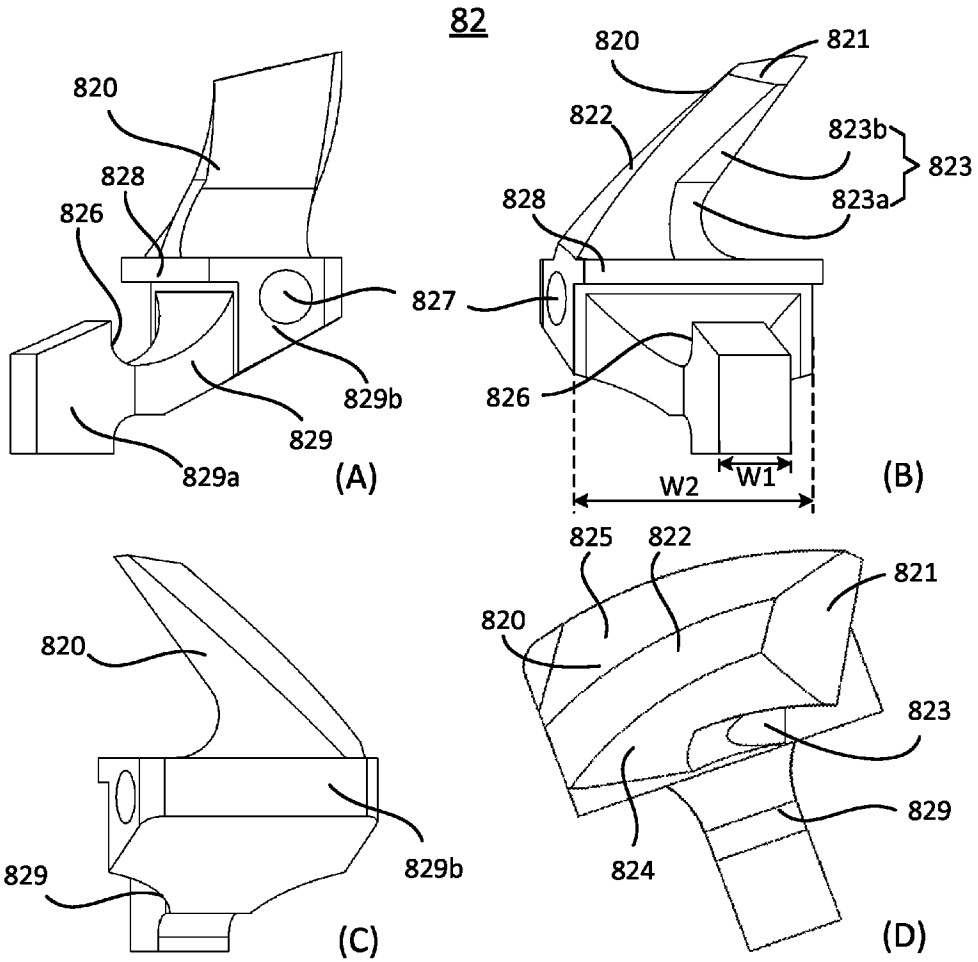
FIG. 5 shows an engagement block of a transmission unit utilized in a transmission device according to one embodiment of the present invention, (A)-(D) different perspective views.
Figure 8:
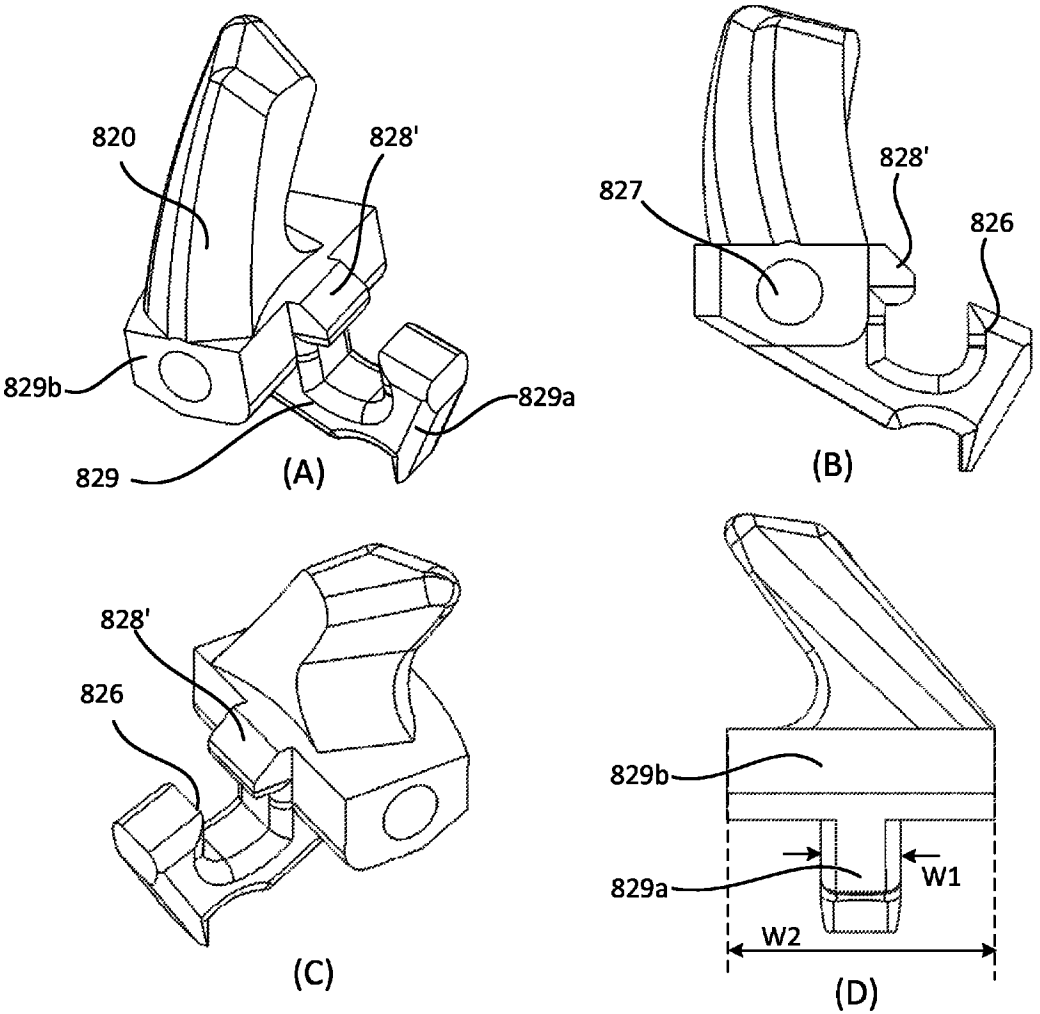
FIG. 8 shows an engagement block of a transmission unit utilized in a transmission device according to another embodiment of the present invention, (A)-(D) different perspective views.

As shown in FIGS. 5 and 8, each engagement block 82 has an outer surface 825 extending gradually close to the drum axis L toward the first direction D1, an inner surface 824 facing the receiving space 86, an inclined top surface 822 at a junction between the outer surface 825 and the inner surface 824, an engagement concave 823 at another junction between the outer surface 825 and the inner surface 824, and a vertex 821 located between the inclined top surface 822 and the engagement concave 823. The included angle between the extending direction of the inclined top surface 822 and the drum axis L is about 30 to 80 degrees. The engagement concaves 823 of the engagement blocks 82 are opened substantially toward opposite directions for allowing the pillars 92 of the drive member of the electronic imaging device to enter the engagement concaves 823 through openings of the engagement concaves 823. Each engagement concave 823 has an arched recess 823*a* and a limiting surface 823*b* located between the recess 823*a* and the vertex 821 and substantially inclined from the vertex 821 toward the inclined top surface 822. The engagement concaves 823 of the engagement blocks 82 are opened substantially toward opposite directions.

As shown in FIGS. 5 and 8, the first end portion 829*a* and the second end portion of the bottom member 829 of each engagement block 82 have a first width, W1, and a second width, W2, respectively. The first width W1 is narrower than the second width W2.

In certain embodiments, the hook 826 of each engagement block 82 is a T-shaped hook. In addition, each engagement block 82 also has a through hole 827 defined in the second portion 829*b* of the bottom member 829, as shown in FIGS. 5 and 8. The through hole 827 is coincident with the pivotal axis.

Further, each engagement block 82 has a rotation limiting member 828 formed in the second portion 829*b* of the bottom member 829 and being toward the first end portion 829*a* of the bottom member 829. In one embodiment, as shown in FIG. 5, the rotation limiting member 828 extends from one side to the other side the second portion 829*b* of the bottom member 829, and has the same width (W2) as the second portion 829*b* of the bottom member 829. However, in another embodiment, as shown in FIG. 8, the rotation limiting member 828' extends from the middle of the second portion 829*b* of the bottom member 829, and has a width that is essentially the same as that (W1) of the first portion 829*a* of the bottom member 829, and is narrower than that (W2) of the second portion 829*b* of the bottom member 829.

Figure 3:
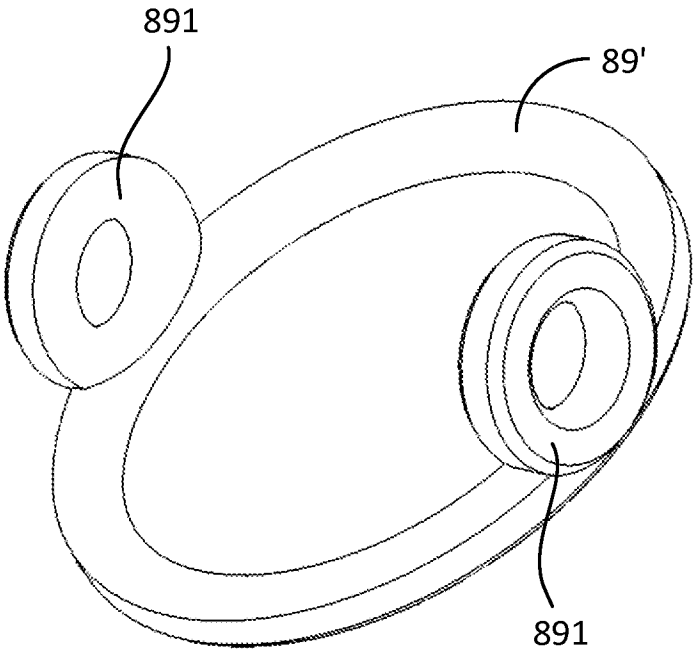
FIG. 3 shows a perspective view of a holding member utilized in a transmission device according to two embodiments (A) and (B) of the present invention.
Figure 3:
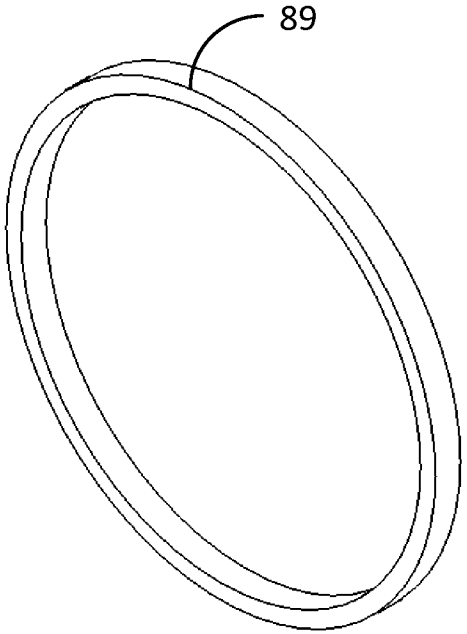

Moreover, the engagement structure 80 also includes a holding member 89 engaged with the hook 826 of the bottom member 825 of each engagement block 82. The holding member 89 can be an elastic ring, a magnet, or a spring. In the embodiment, shown in FIG. 3A, the holding member is an elastic ring 89. The elastic ring 89 may be formed of an elastic material comprising plastic, or silicon. In this exemplary embodiment, the hooks 826 of the bottom members 825 of the two engagement blocks 82 are hooked by the elastic ring 89. In another embodiment, as shown in FIG. 2B, the elastic ring 89' comprises two ear rings 891 formed on the two opposite sides of the elastic ring 89'. As such, the hooks 826 of the bottom members 825 of the two engagement blocks 82 are hooked by the ear rings 891 of the elastic ring 89'. Alternatively, a spring may be used to connect the hooks 826 of the bottom members 825 of the two engagement blocks 82. In addition, a magnetic force may be utilized to force the two engagement blocks 82 to be in the normal state.

Figure 6:
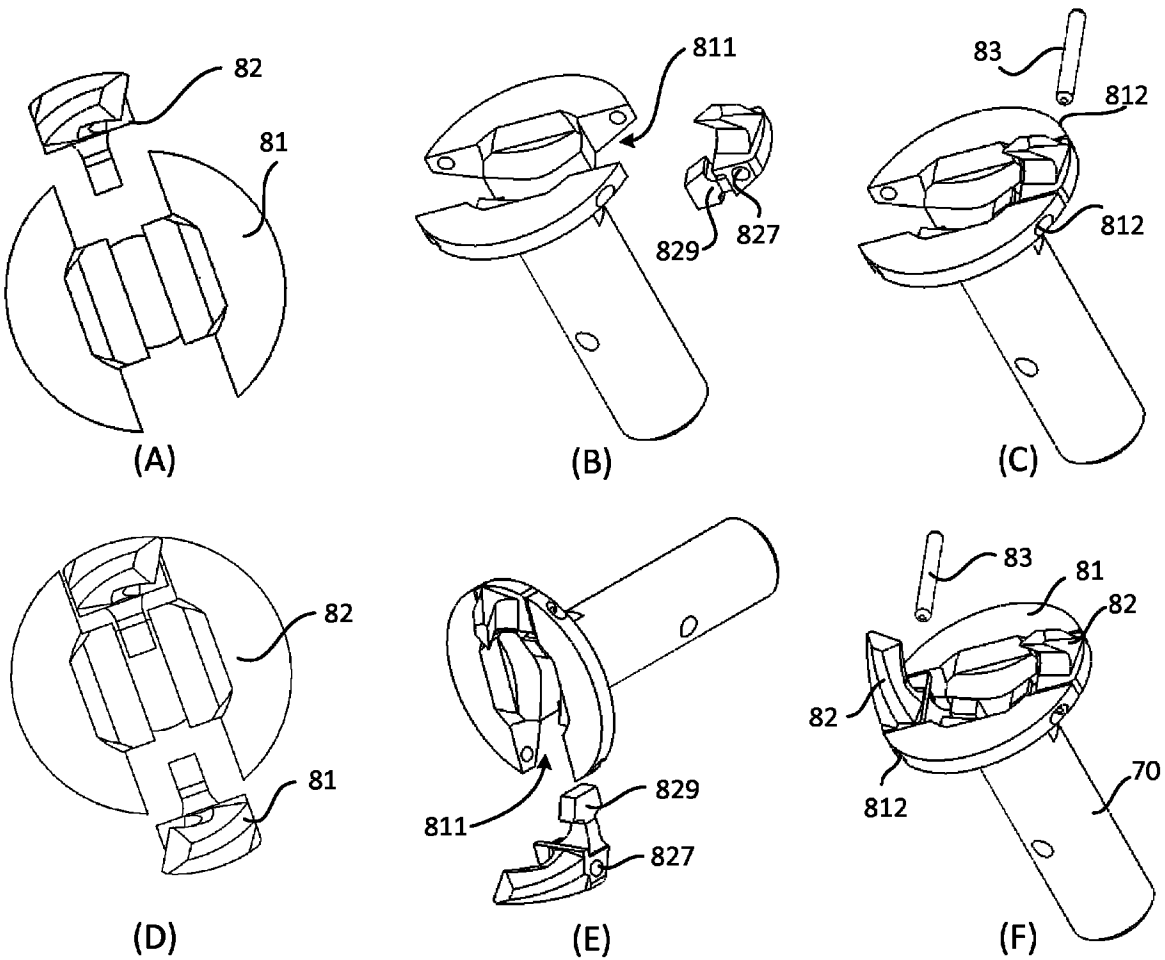
FIG. 6 shows an assembly process (A)-(F) of a transmission unit utilized in a transmission device according to one embodiment of the present invention.
Figure 9:
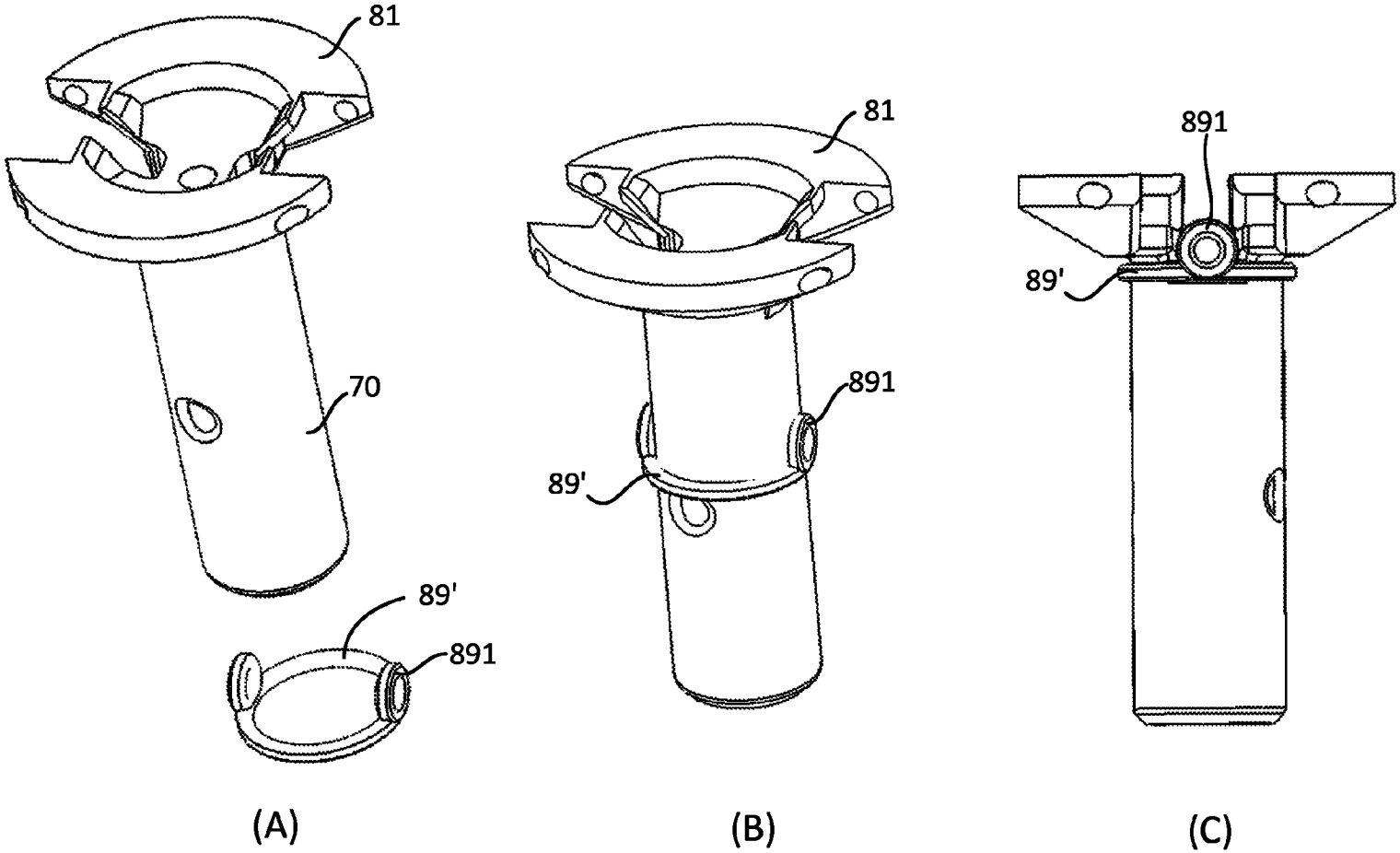
FIGS. 9 and 10 show an assembly process (9A-9C and 10A-10F) of a transmission unit utilized in a transmission device according to another embodiment of the present invention.
Figure 10:
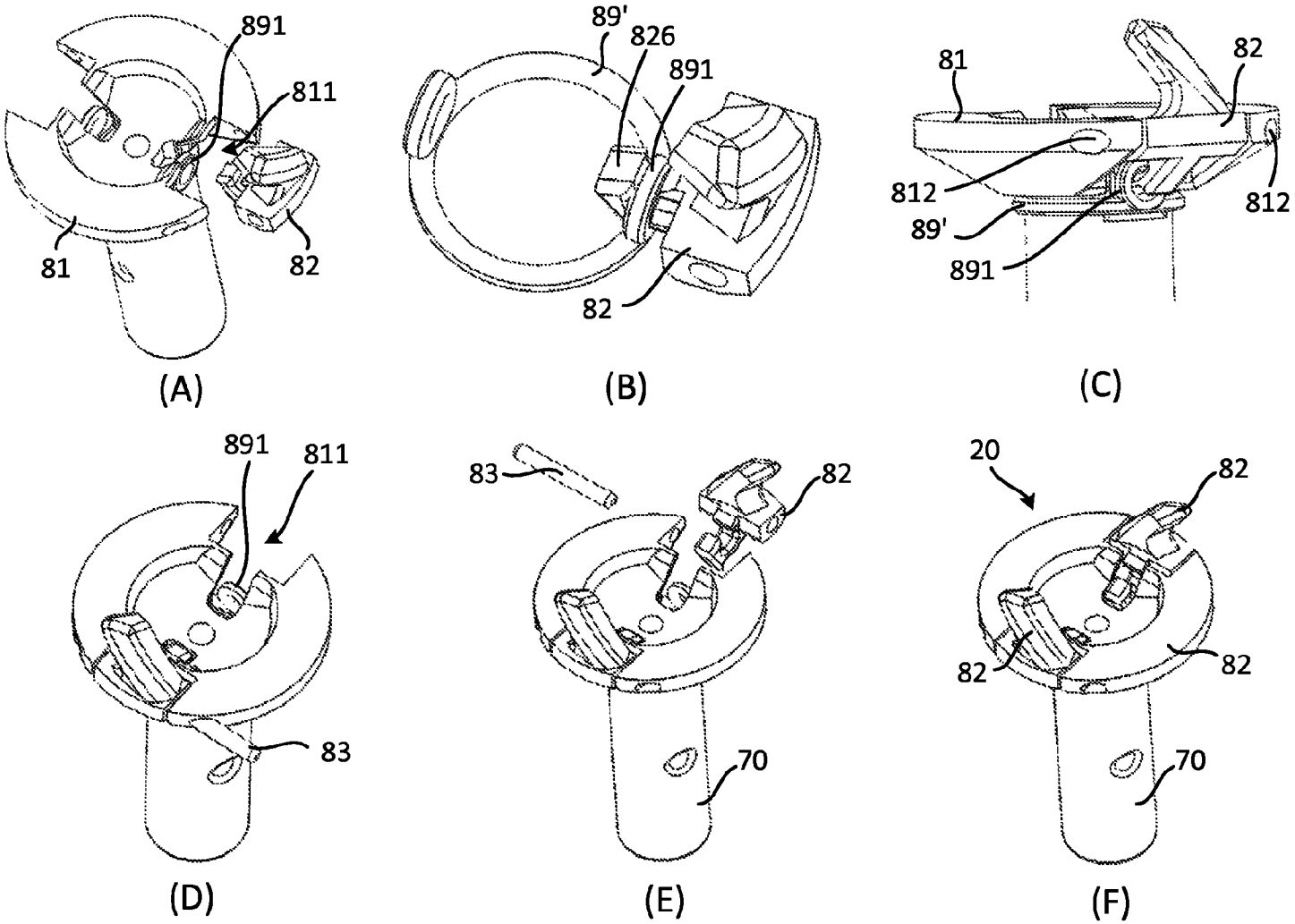

According to the invention, the assembly process of the transmission unit 20 is very simple. As shown in FIGS. 6, 9 and 10, the two engagement blocks 82 are received in the notched receptacle 811 and pivotally secured to the base 81 by two pins 83. For example, each engagement block 82 is placed into a respective opening 811*a* and groove 811*b*, a pin 83 is inserted through the through hole 827 of the engagement block 82 and a respective pair of holes 812 of the base 81 to pivotally attach the engagement block 82 to the base 81, and the holding member (elastic ring) 89 is then placed to hook the hooks 826 of the two engagement blocks 82, as shown in FIG. 6. Alternatively, as shown in FIGS. 9 and 10, first, the shaft 70 is inserted in the elastic ring 89' to position the ear rings 891 in the grooves 811*b*. Then, each engagement block 82 is placed into a respective opening 811*a* and groove 811*b*, the hooks 826 of the two engagement blocks 82 are inserted into the ear rings 891 of the elastic ring 89', and a pin 83 is inserted through the through hole 827 of the engagement block 82 and a respective pair of holes 812 of the base 81 to pivotally attach the engagement block 82 to the base 81.

As such, the second end portion 829*b* of the bottom member 829 of each engagement block 82 is received in the respective opening 811*a*, the first end portion 829*a* of the bottom member 829 of each engagement block 82 is received in the respective groove 811*b*, and each engagement block 82 is rotatable around its pivotal axis, i.e., its corresponding pin 83. The engagement blocks 82 extends helically from two opposite sides of the base 8, respectively, which are about the upside and the downside of the base 81 shown in FIGS. 2A and 2B, away from the drum axis L and toward the first direction D1. The pulling force exerts on the hooks 826 of the two engagement blocks 82 by the elastic ring 89 (or 89') makes the engagement blocks 82 in the normal state.

Furthermore, the transmission device comprises a transmission unit 20 also includes a sleeve 30, a gear member 60 and an elastic member 50.

Figure 11:
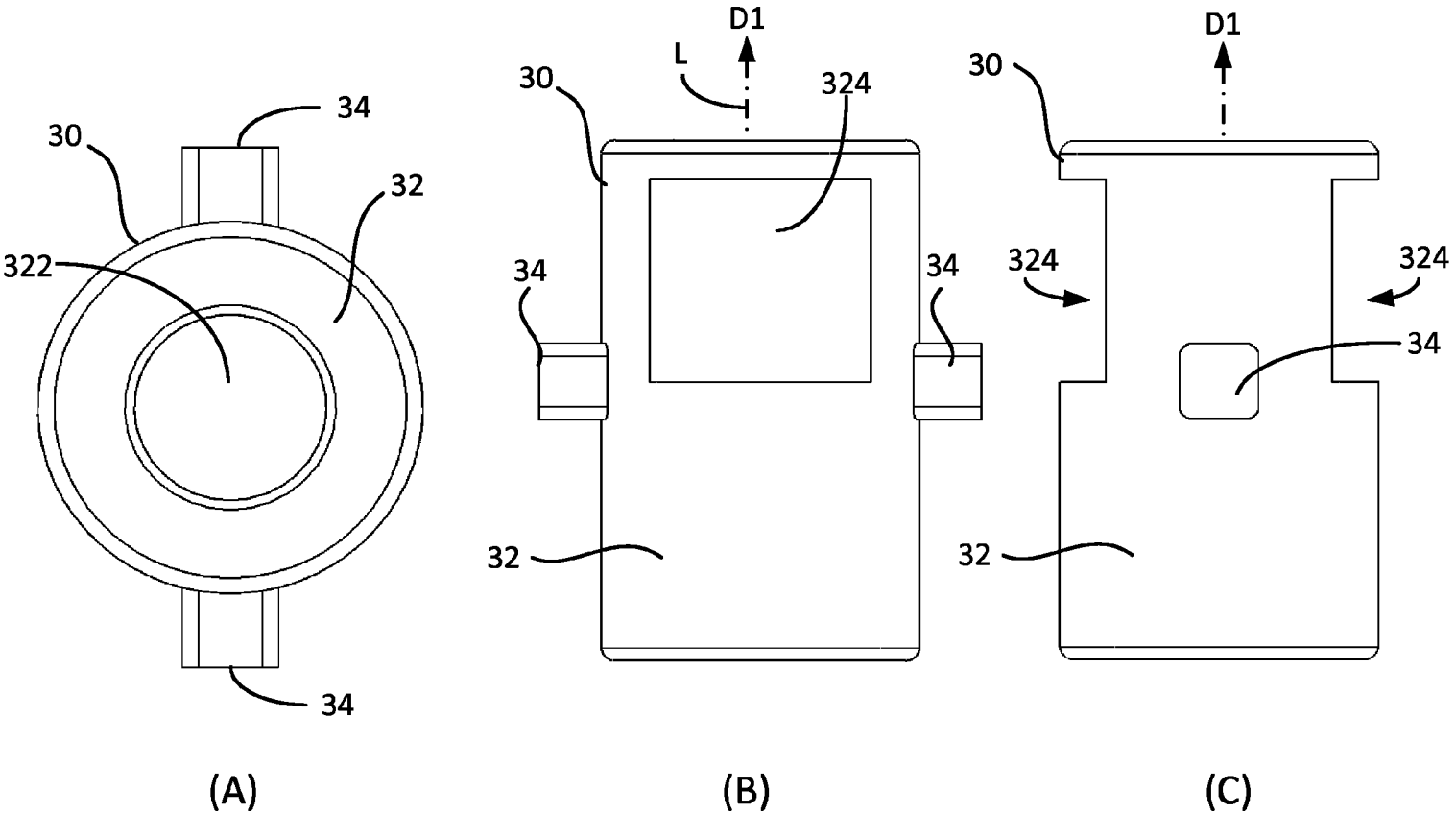
FIG. 11 shows a sleeve utilized in a transmission device for a photosensitive drum according to one embodiment of the present invention, (A) a top view, (B) a cross-section view, and (C) another cross-section view.
Figure 12:
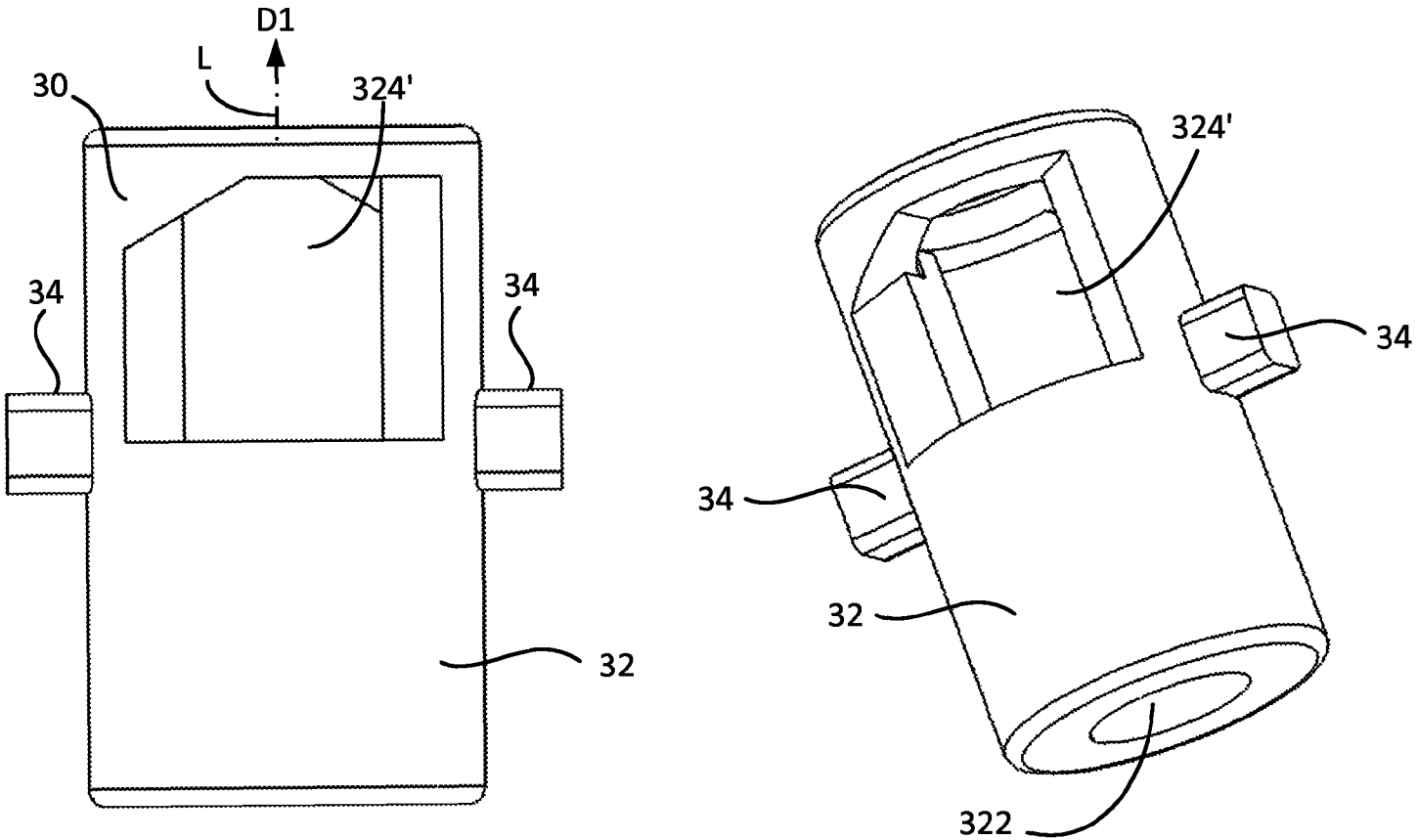
FIG. 12 shows a sleeve utilized in a transmission device for a photosensitive drum according to one embodiment of the present invention, (A) a cross-section view, and (B) a perspective view.

Referring to FIGS. 2A, 2B, 11 and 12, and particularly to FIGS. 11 and 12, the sleeve 30 comprises a main body 32, an axial hole 322 defined through the main body 32 along the drum axis L, two guiding grooves 324 formed on the main body 32, communicated with the axial hole 322, and two pillars 34 protruding from the main body 32. Only one of the guiding grooves 324 is shown in the figures, and the other groove 324 is located opposite to the groove 324 shown in the figures.

As shown in FIG. 11, each guiding groove 324 is in a shape of rectangle, and has a bottom side substantially perpendicular to the drum axis L, two lateral sides respectively extending from two ends of the bottom side toward to the first direction D1, and a top side connected between the two lateral sides and parallel to the bottom side. As shown in FIG. 12, the top side has a sloped portion and an extending portion parallel to the bottom side. It should be appreciated to one skilled in the art that other types of the sleeve can also be utilized to practice the invention.

According to the invention, as assembled, the shaft 70 of the transmission unit 20 is disposed in the axial hole 322 and capable of rotating about the drum axis L relative to the sleeve 30 and moving along the drum axis L relative to the sleeve 30. The pin 40 is inserted into the opening 73 of the transmission unit 20 in such a way that the shaft 70 of the transmission unit 20 has two protrusions 75 extending along the shaft's radial direction, as shown in FIG. 2B. The protrusions 75, which are formed by the two parts of the pin 40 that protrude out of the opening 73, are movably received in the guiding grooves 324, respectively.

It should be appreciated to one skilled in the art that the opening 73 of the transmission unit 20 can also be provided without penetrating the shaft 70. For example, the shaft 70 of the transmission unit 20 may have only one protrusion 75 and the sleeve 30 only needs to be provided with one guiding groove 324. Besides, the protrusion 75 of the shaft 70 is not limited to be formed by the pin 40 inserted into the opening 73. For example, the protrusion 75 can be protruded from the shaft body 74 integrally; in that condition, the guiding groove 324 should have an open end so that the protrusion 75 can enter the guiding groove 324 through its open end, and the open end of the guiding groove 324 should be capped by an annular cap provided at, but not limited to, the shaft 70.

Figure 13:
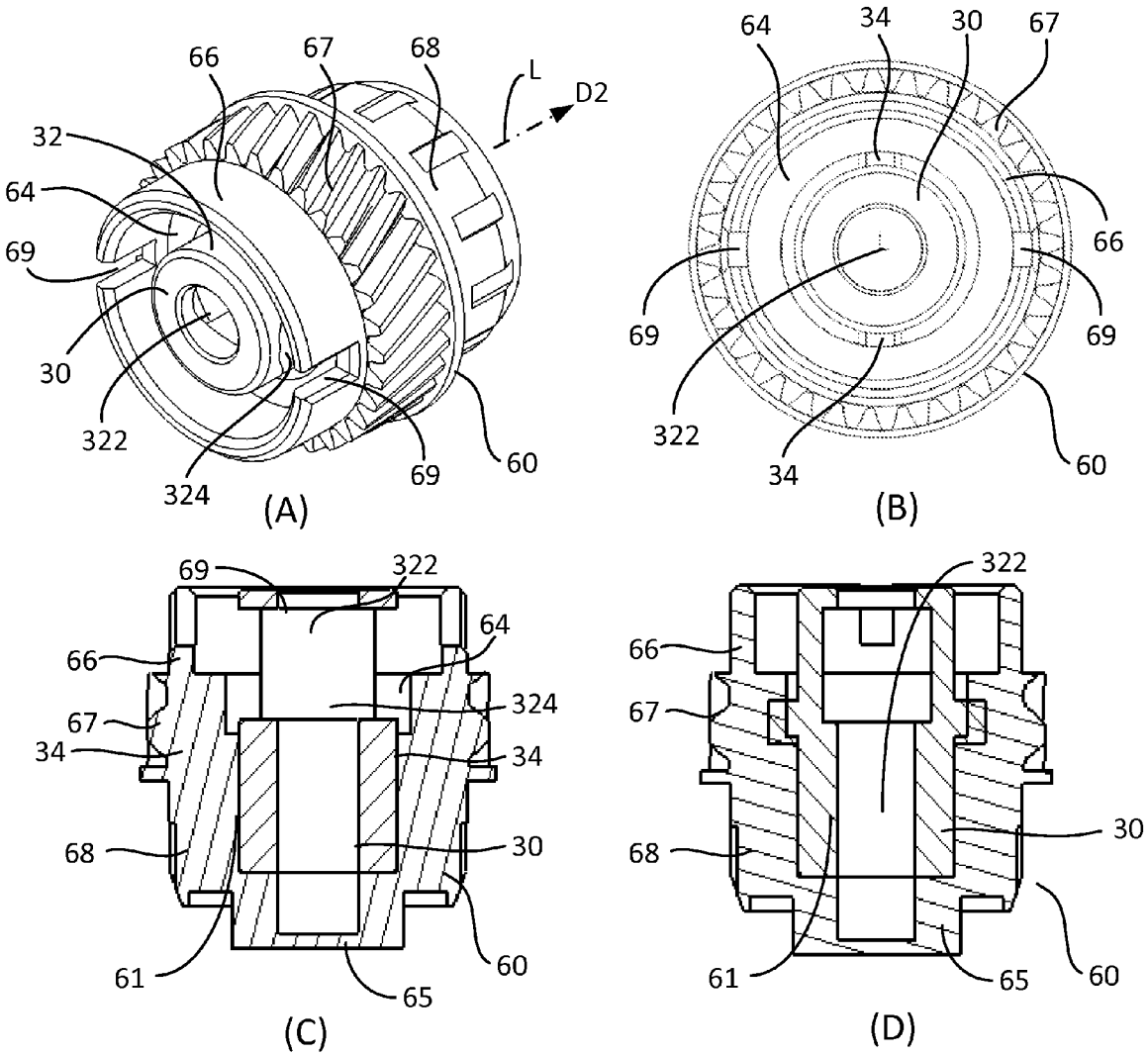
FIG. 13 shows a gear member and a sleeve assembled in the gear member utilized in a transmission device according to one embodiment of the present invention, (A) a perspective view, (B) a top view, (C) a cross-section view, and (D) another cross-section view.
Figure 15:
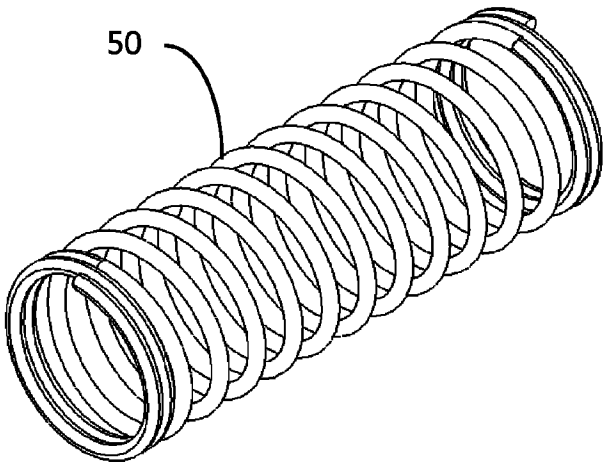
FIG. 15 shows an elastic member utilized in a transmission device according to one embodiment of the present invention.
Figure 14:
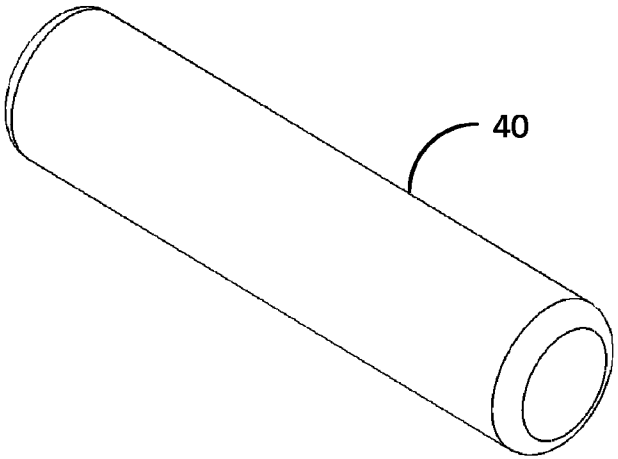
FIG. 14 shows a pin utilized in a transmission device for a photosensitive drum according to one embodiment of the present invention.

Referring to FIGS. 2A, 2B and 13, the gear member 60 is adapted for engaging with the photosensitive drum and has the gear member 60 has a top portion 66, a gear portion 67 extending from the top portion 66 along the drum axis L toward the second direction D2, a bottom portion 68 extending from the gear portion 67 along the drum axis L toward the second direction D2, a top wall 64 located at the side of the top portion 66, and a bottom wall 65 located at the side of the bottom portion 68. In addition, the top portion 66 of the gear member 60 may have at least one slot 69. The peripheral configuration of the gear member 60 is similar to the conventional ones. Inside the gear member 60, there is a housing 61 defined along the drum axis L for receiving the main body 32 of the sleeve 30 so that the sleeve 30 is coupled with the gear member 60 unrotatably around the drum axis L. In certain embodiments, the sleeve 30 is molded in the gear member 60.

In certain embodiments, the gear member 60 has an installation slot formed on the top wall 64, and two limiting recesses communicated with each other. The housing 61 extends along the drum axis L and opened on the top wall 64. The installation slot extends from the housing 61 toward the two opposite radial directions of the housing 61 and opened on the top wall 64. The limiting recesses are located adjacent to the installation slot, extending parallel to the drum axis L and not opened on the top wall 64. The sleeve 30 may further have two pillars 34 protruding from the main body 32. In assembly, the two pillars 34 of the sleeve 30 are inserted into the housing 61 through the installation slot, and then the sleeve 30 is turned to cause the pillars 34 to enter the limiting recesses so that the sleeve 30 is limited in the gear member 60. The details of such embodiments are disclosed in the pending U.S. patent application Ser. Nos. 14/461,011, 13/965,856 and 14/310,615, which are hereby incorporated herein in their entireties by reference, and not repeated herein.

According to the invention, the assembly process of the transmission device is very simple. As shown in FIG. 16A, first, the elastic member 50 is disposed in the axial hole 322 of the sleeve 30. The axial hole 322 of the sleeve 30 is in communication with the housing 61 of the gear member 60. Then, the shaft 70 of the transmission unit 20 is inserted in the axial hole 322 of the sleeve 30, as shown in FIG. 16B. Next, the pin 40 is inserted into the opening 73 of the shaft 70 of the transmission unit 20 through the through slots 69 of the gear member 60 and the guiding grooves 324 of the sleeve 30, as shown in FIG. 16C. As such, the two end portions (i.e., protrusions 75) of the pin 40 are retained and moveably limited in the guiding grooves 324, and two ends of the elastic member 50 are abutted against the bottom wall 65 of the gear member 60 and the second end 72 of the shaft 70 of the transmission unit 20, respectively, so that a force generated by the elastic member 50 exerts on the second end 72 of the shaft 70 of the transmission unit 20 along the drum axis L, which makes the pin 40 (i.e., protrusions 75) of the shaft 70 in a position against the top side or vertex of the guiding grooves 324 of the sleeve 30 in a normal state of the transmission device.

Figure 17:
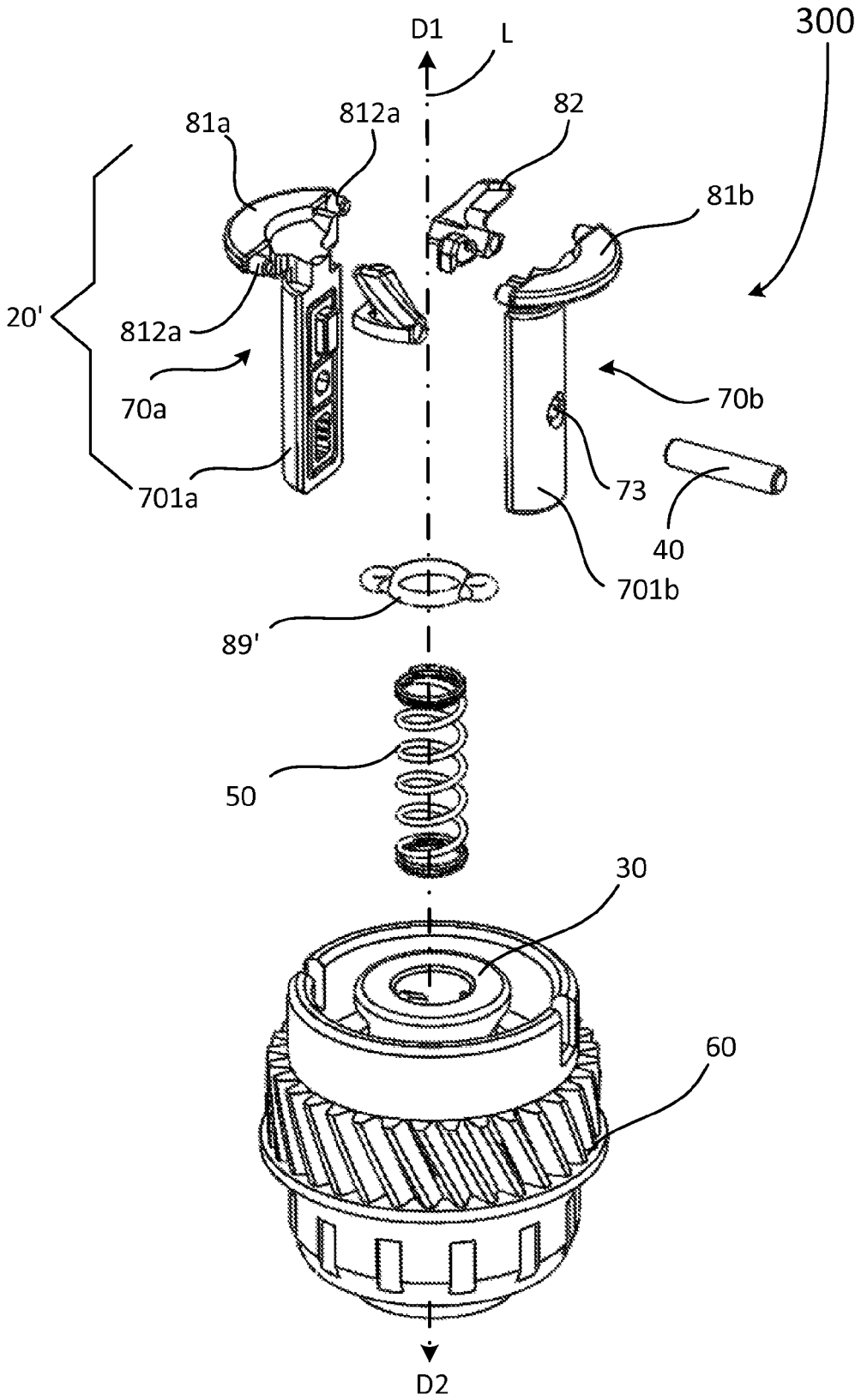
FIG. 17 shows an exploded perspective view of a transmission device according to one embodiment of the present invention.
Figure 18:
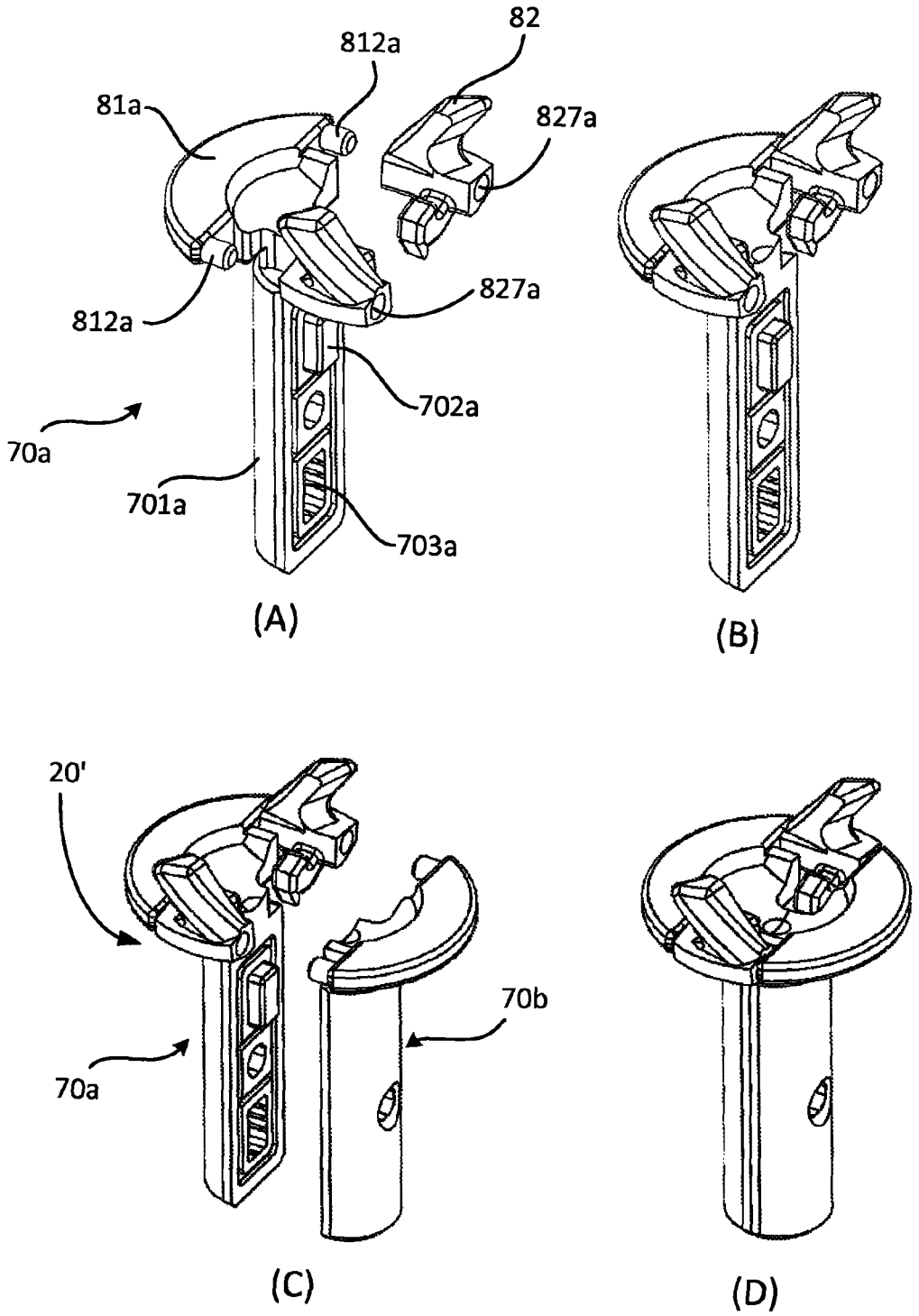
FIG. 18 shows a transmission unit and its assembly process (A)-(D) of according to one embodiment of the present invention.

FIG. 17 shows one embodiment of a transmission device 300, which is essentially the same as the transmission device 200 shown in FIG. 2B, except that the transmission unit 20' utilized in the transmission device 300 is different from that (20) of the transmission device 200. FIG. 18 shows this embodiment of the transmission unit 20' that includes the shaft, the base, and the two engagement blocks.

Referring to FIGS. 17 and 18, the shaft 70 in this exemplary embodiment, comprises a first part 70*a* and a second part 70*b*, each part 70*a*/70*b* comprising a semi-cylindrical body 701*a*/701*b*. The base 81 also has two portions 81*a* and 81*b*, each base portion 81*a*/81*b* extending from one end of the respective semi-cylindrical body 701*a*/701*b*. The semi-cylindrical bodies 701*a* and 701*b* of the first and second parts 70*a* and 70*b* are detachably attachable to each other.

In this embodiment, each semi-cylindrical body 701*a*/701*b* has an elongated plane surface parallel to the drum axis L, at least one protrusion 702*a* protruded from the elongated plane surface, and at least one recess 703*a* recessed from the elongated plane surface. As such, when assembled, the at least one protrusion 702*a* of the semi-cylindrical body 701*a* of the first part 70*a* is received in the at least one recess 703*b* of the semi-cylindrical body 701*b* of the second part 70*b*, and the at least one protrusion 702*b* of the semi-cylindrical body 701*b* of the second part 70*b* is received in the at least one recess 703*a* of the semi-cylindrical body 701*a* of the first part 70*a*. In other words, the semi-cylindrical bodies 701*a* and 701*b* of the first and second parts 70*a* and 70*b* of the shaft 70 can be detachably snapped to each other.

In this embodiment, the base 81 has two base portions 81*a*/81*b*. Each base portion 81*a*/81*b* has two pins 812*a* extending towards the at least two notched receptacles 811, respectively, such that, as assembled, each pin 812*a* is coincident with the pivotal axis.

In this embodiment, each engagement block 82 is essentially the same as that shown in FIG. 8, except that two holes 827*a*, instead of a through hole, are oppositely defined in the bottom member. As such, when assembled, the pins 812*a* of the base portions 81*a* and 81*b* are received in the two holes 827*a* of the engagement blocks 82. Accordingly, each engagement block 82 is rotatable around the pivotal axis at the second end portion 829*b* of the bottom member 829.

Figure 19:
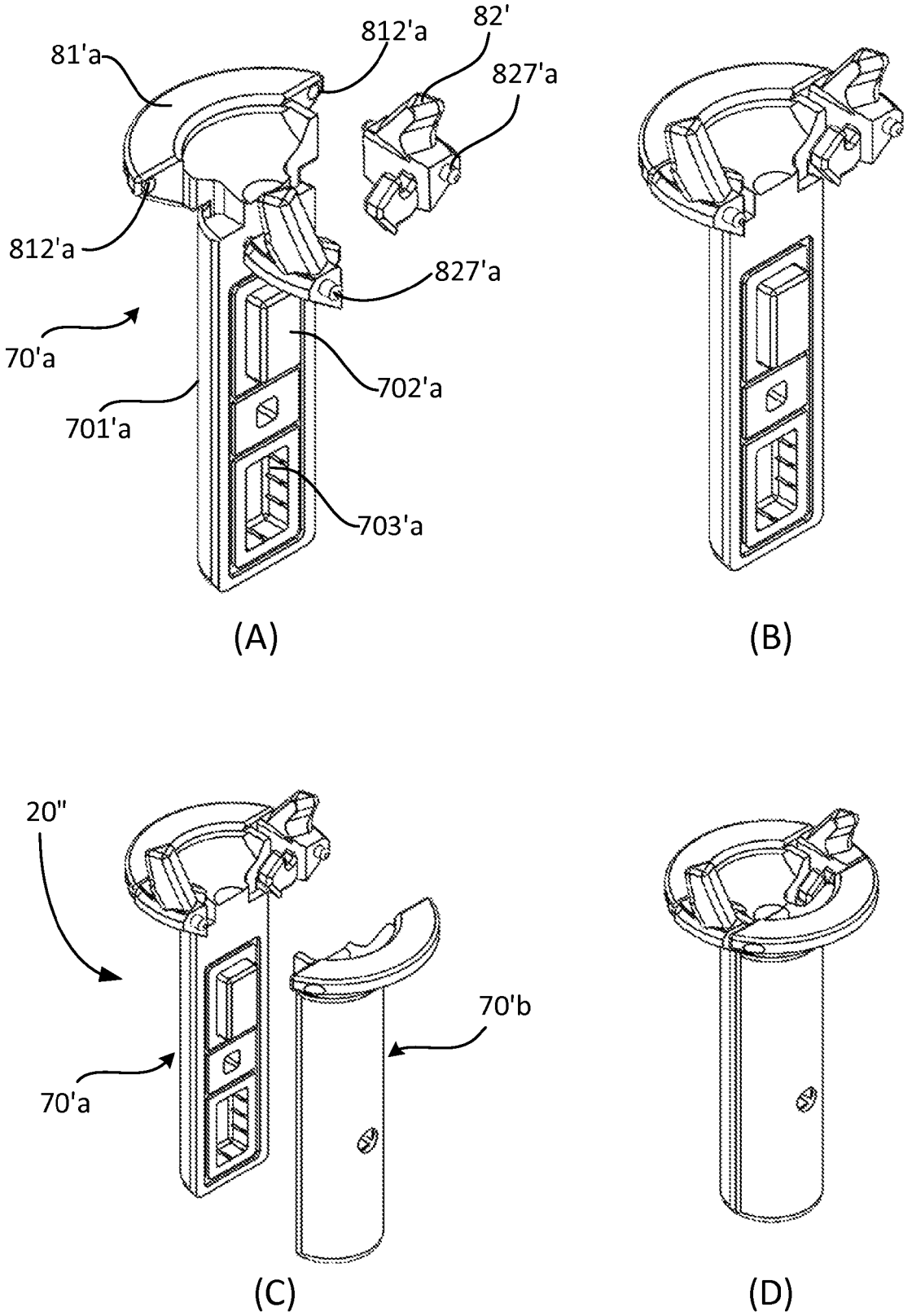
FIG. 19 shows a transmission unit and its assembly process (A)-(D) of according to another embodiment of the present invention.

FIG. 19 shows another embodiment of a transmission unit 20", which is essentially the same as the transmission unit 20' shown in FIG. 18, except that the base portions and engagement blocks utilized in the transmission unit 20" are different from that of the transmission unit 20'. In the exemplary embodiment, each base portion 81'*a*/81'*b* has two holes 812'*a* defined facing the at least two notched receptacles 811, respectively, such that, as assembled, each hole 812'*a* is coincident with the pivotal axis. In addition, each engagement block 82' has two pins 827'*a* oppositely protruded from its bottom member. As such, when assembled, the two pins 827'*a* of each engagement block 82' are received in the corresponding holes 812'*a* of the base portions 81'*a* and 81'*b*. Accordingly, each engagement block 82' is rotatable around the pivotal axis.

Figure 20:
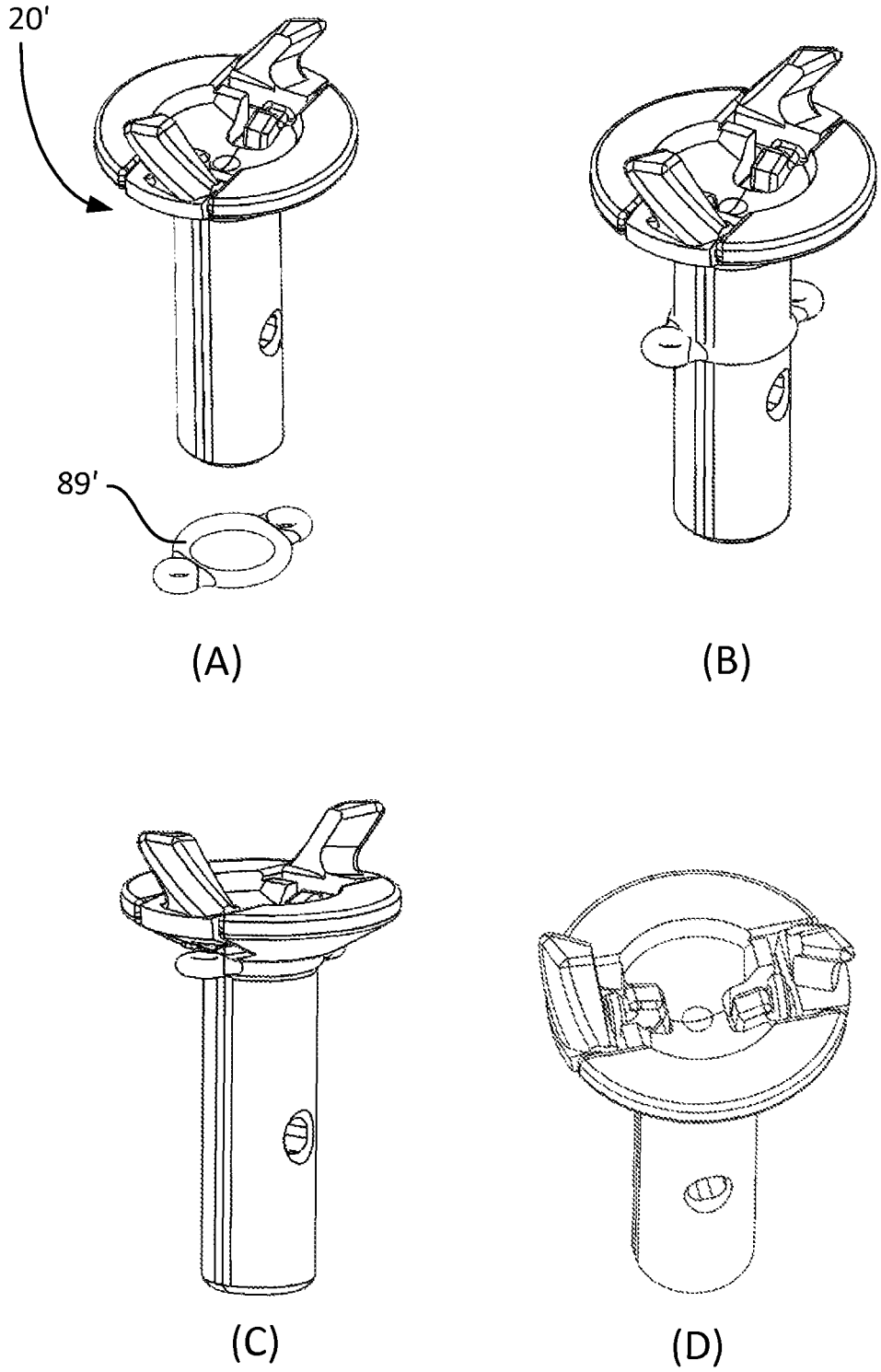
FIG. 20 shows an assembly process (A)-(D) of a transmission unit with a holding member according to one embodiment of the present invention.

FIG. 20 shows an assembly process of the transmission unit 20' (or 20") with a holding member 89' according to one embodiment of the present invention, which is the same as that shown in FIG. 9. In this exemplary embodiment, the elastic ring 89' comprises two ear rings formed on the two opposite sides of the elastic ring 89'. As such, the hooks 826 of the bottom members 825 of the two engagement blocks 82 are hooked by the ear rings 891 of the elastic ring 89'. Alternatively, a spring may be used to connect the hooks 826 of the bottom members 825 of the two engagement blocks 82.

Figure 16:
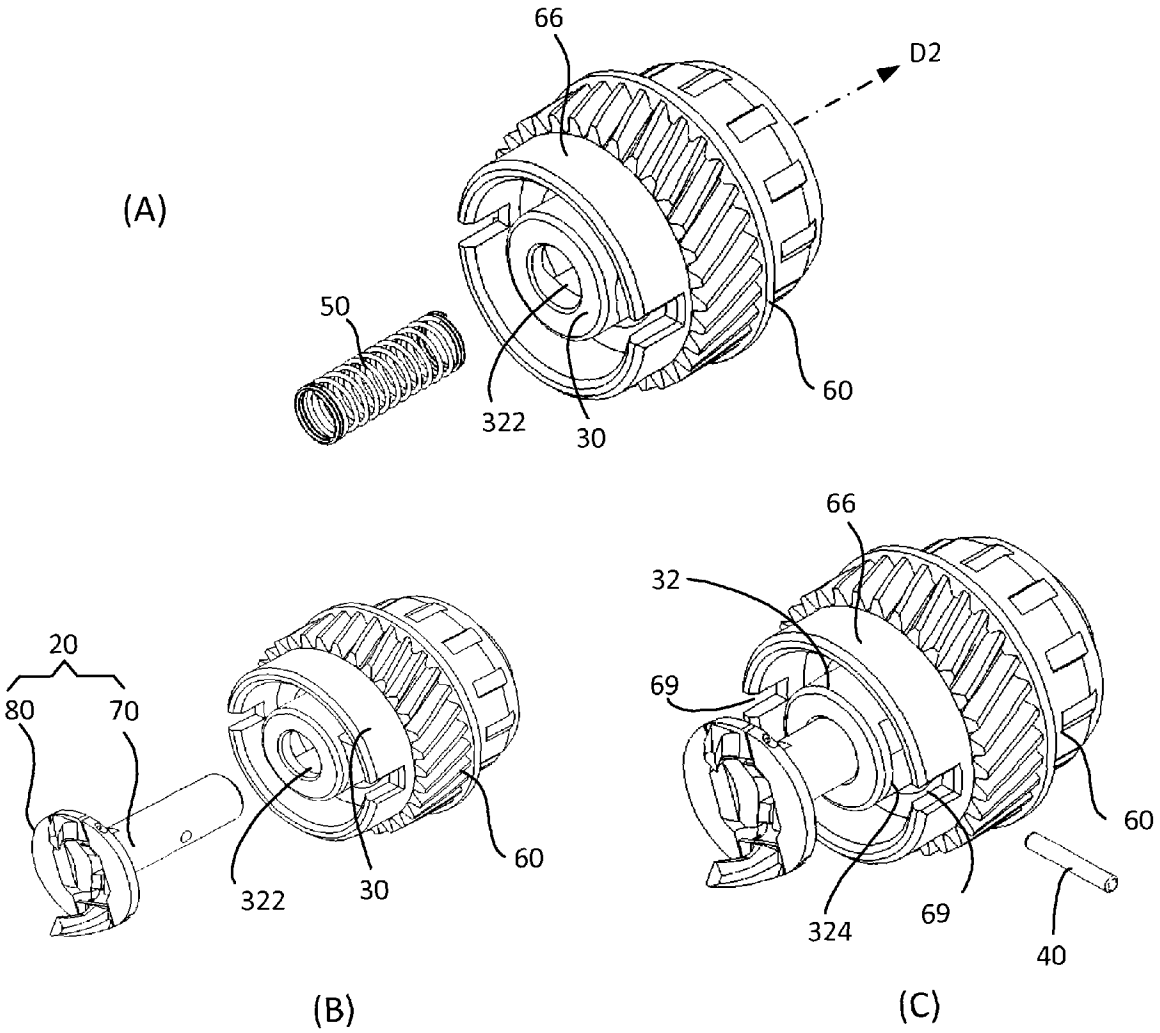
FIG. 16 shows an assembly process (A)-(C) of a transmission device according to one embodiment of the present invention.
Figure 21:
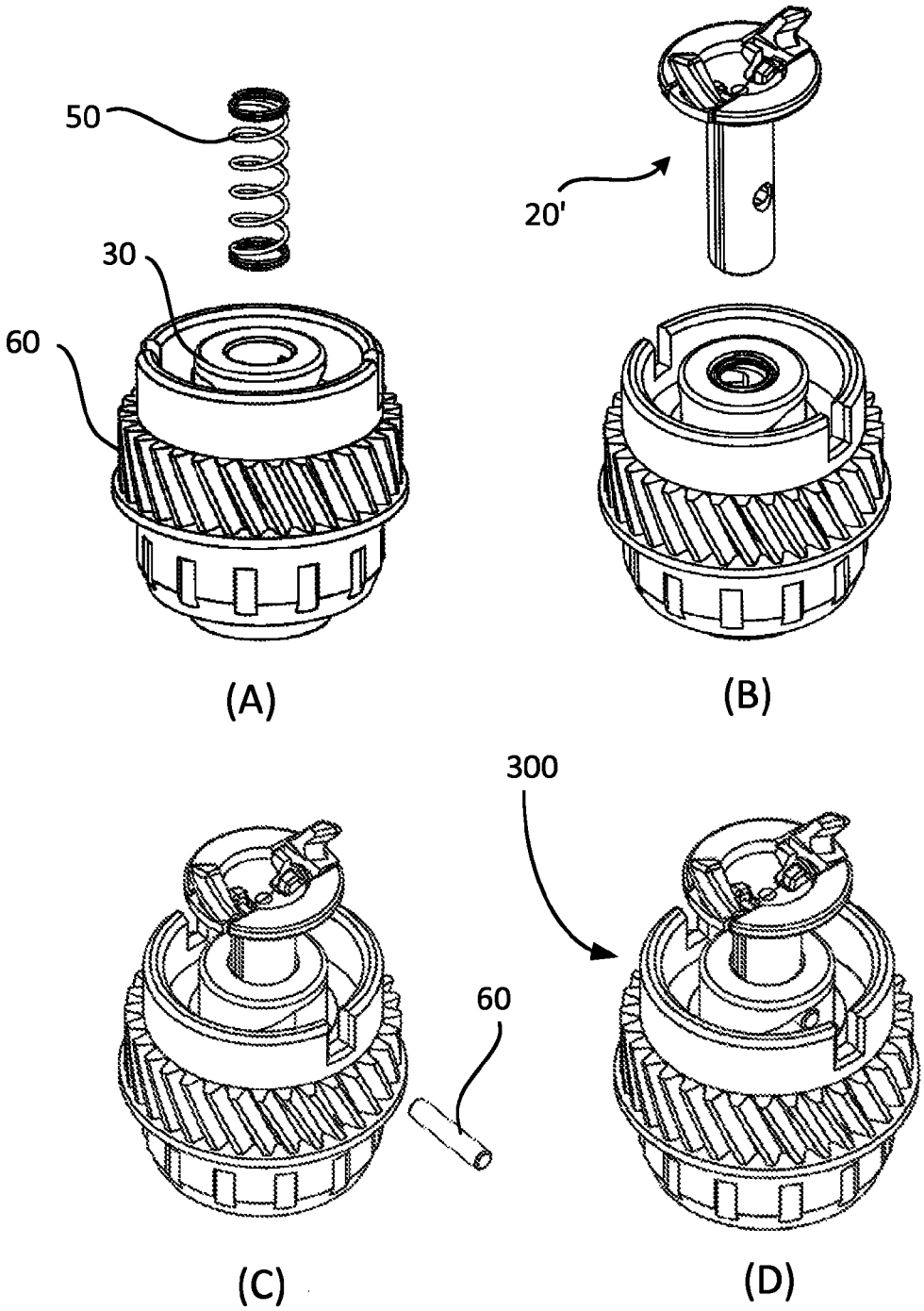
FIG. 21 shows an assembly process (A)-(D) of a transmission device according to one embodiment of the present invention.

FIG. 21 shows an assembly process of the transmission device 300, which the same as that of the transmission device 100 shown in FIG. 16. At first, the elastic member 50 is disposed in the axial hole of the sleeve 30, as shown in FIG. 21A. The axial hole of the sleeve 30 is in communication with the housing of the gear member (shell) 60. Then, the shaft of the transmission unit 20' is inserted in the axial hole of the sleeve 30, as shown in FIG. 21B. Next, the pin 40 is inserted into the opening of the shaft of the transmission unit 20' through the through slots of the gear member 60 and the guiding grooves of the sleeve 30, as shown in FIG. 21C. As such, the two end portions (i.e., protrusions) of the pin 40 are retained and moveably limited in the guiding grooves, and two ends of the elastic member 50 are abutted against the bottom wall of the gear member 60 and the second end of the shaft of the transmission unit 20', respectively, so that a force generated by the elastic member 50 exerts on the second end of the shaft of the transmission unit 20' along the drum axis L, which makes the pin 40 (i.e., protrusions) of the shaft in a position against the top side or vertex of the guiding grooves of the sleeve 30 in a normal state of the transmission device 300.

When the transmission device 100/200/300 is used, the shell is fastened to a photosensitive drum which is adapted for installation in a toner cartridge (not shown), and the engagement structure of the transmission unit sticks out of an end of the toner cartridge. When the user puts the toner cartridge into a housing of an electronic image forming apparatus (not shown), the engagement structure of the transmission unit will be engaged with a drive member of the electronic imaging device located in the housing in such a way that a part of the drive member of the electronic imaging device is received in the receiving space and the engagement concaves are received and engaged with two pillars of the drive member of the electronic imaging device respectively so that the photosensitive drum will be driven to rotate by the drive member of the electronic imaging device.

According to the present invention, the transmission device is simpler in structure than the conventional ones, and the way that the transmission device is connected with and separated from the drive member of an electronic image forming apparatus is different from the conventional ones. By the feature that the transmission unit can move along the drum axis L and rotate about the drum axis L at the same time and the specially designed shape of the engagement blocks of the transmission unit, no matter what angle the transmission device is presented when entering or exiting the housing of the electronic imaging device, the transmission unit will be connected with the drive member firmly and separated from the drive member smoothly.

The detailed processes of how the transmission device is connected with and separated from the drive member are disclosed in the pending U.S. patent application Ser. No. 14/461,011, which is hereby incorporated herein in its entirety by reference, and not repeated herein.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A drum unit, comprising:

a photosensitive drum having a drum axis;

a shell detachably attached to the photosensitive drum coaxially to the drum axis;

a sleeve coupled with the shell coaxially to the drum axis; and a transmission unit disposed to the sleeve coaxially to the drum axis, the transmission unit comprising;

a shaft that is rotatable about the drum axis relative to the sleeve and movable along the drum axis relative to the sleeve, and has a base at one end of the shaft; and at least two engagement blocks extending from two opposite sides of the base away from the drum axis, wherein each engagement block is rotatable around a pivotal axis provided at the two opposite sides of the base, the pivotal axis being perpendicular to the drum axis.

2. The drum unit as claimed in claim 1, wherein the base has at least two notched receptacles defined in the two opposite sides of the base, wherein each engagement block is pivotally retained in a respective notched receptacle such that each engagement block is rotatable around the pivotal axis.

3. The drum unit as claimed in claim 2, wherein each engagement block has a bottom member, an engagement claw upwards extending from the bottom member, and a through hole defined such that, as assembled, the through hole is coincident with the pivotal axis.

4. The drum unit as claimed in claim 3, wherein each engagement block is pivotally attached to the base by a pin inserted through the through hole.

5. The drum unit as claimed in claim 2, wherein the shaft comprises a first part and a second part, each part comprising a semi-cylindrical body, and a base portion attached to one end of the semi-cylindrical body, wherein the semi-cylindrical bodies of the first and second parts are detachably attachable to each other.

6. The drum unit as claimed in claim 5, wherein each semi-cylindrical body has at least one protrusion protruded from a plane surface of the semi-cylindrical body, and at least one recess recessed from the plane surface of the semi-cylindrical body.

7. The drum unit as claimed in claim 6, wherein, as assembled, the at least one protrusion of the semi-cylindrical body of the first part is received in the at least one recess of the semi-cylindrical body of the second part, and the at least one protrusion of the semi-cylindrical body of the second part is received in the at least one recess of the semi-cylindrical body of the first part.

8. The drum unit as claimed in claim 5, wherein each base portion has two pins extending towards the at least two notched receptacles, respectively, such that, as assembled, each pin is coincident with the pivotal axis.

9. The drum unit as claimed in claim 8, wherein each engagement block has a bottom member, an engagement claw upwards extending from the bottom member, and two holes oppositely defined such that, as assembled, the pins of the base portions are received in the two holes of each engagement block.

10. The drum unit as claimed in claim 5, wherein each base portion has two holes defined facing the at least two notched receptacles, respectively, such that, as assembled, each hole is coincident with the pivotal axis.

11. The drum unit as claimed in claim 10, wherein each engagement block has a bottom member, an engagement claw upwards extending from the bottom member, and two pins oppositely protruded such that, as assembled, the two pins of each engagement block are received in the corresponding holes of the base portions.

12. The drum unit as claimed in claim 1, wherein the sleeve is integrally formed with the shell coaxially to the drum axis.

13. A transmission unit for engagement with a photosensitive drum having a drum axis, wherein a sleeve is coaxially coupled to the photosensitive drum, comprising:

a shaft that is rotatable about the drum axis relative to the sleeve and movable along the drum axis relative to the sleeve, and has a base at one end of the shaft; and at least two engagement blocks extending from two opposite sides of the base away from the drum axis, wherein each engagement block is rotatable around a pivotal axis provided at the two opposite sides of the base, the pivotal axis being perpendicular to the drum axis.

14. The transmission unit as claimed in claim 13, wherein the base has at least two notched receptacles defined in the two opposite sides of the base, wherein each engagement block is pivotally retained in a respective notched receptacle such that each engagement block is rotatable around the pivotal axis.

15. The transmission unit as claimed in claim 14, wherein each engagement block has a bottom member, an engagement claw upwards extending from the bottom member, and a through hole defined such that, as assembled, the through hole is coincident with the pivotal axis.

16. The transmission unit as claimed in claim 15, wherein each engagement block is pivotally attached to the base by a pin inserted through the through hole.

17. The transmission unit as claimed in claim 14, wherein the shaft comprises a first part and a second part, each part comprising a semi-cylindrical body, and a base portion attached to one end of the semi-cylindrical body, wherein the semi-cylindrical bodies of the first and second parts are detachably attachable to each other.

18. The transmission unit as claimed in claim 17, wherein each semi-cylindrical body has at least one protrusion protruded from a plane surface of semi-cylindrical body, and at least one recess recessed from a plane surface of semi-cylindrical body.

19. The transmission unit as claimed in claim 18, wherein, as assembled, the at least one protrusion of the semi-cylindrical body of the first part is received in the at least one recess of the semi-cylindrical body of the second part, and the at least one protrusion of the semi-cylindrical body of the second part is received in the at least one recess of the semi-cylindrical body of the first part.

20. The transmission unit as claimed in claim 17, wherein each base portion has two pins extending towards the at least two notched receptacles, respectively, such that, as assembled, each pin is coincident with the pivotal axis.

21. The transmission unit as claimed in claim 20, wherein each engagement block has a bottom member, an engagement claw upwards extending from the bottom member, and two holes oppositely defined such that, as assembled, the pins of the base portions are received in the two holes of each engagement block.

22. The transmission unit as claimed in claim 17, wherein each base portion has two holes defined facing the at least two notched receptacles, respectively, such that, as assembled, each hole is coincident with the pivotal axis.

23. The transmission unit as claimed in claim 22, wherein each engagement block has a bottom member, an engagement claw upwards extending from the bottom member, and two pins oppositely protruded such that, as assembled, the two pins of each engagement block are received in the corresponding holes of the base portions.

* * * * *

UNITED STATES PATENT AND TRADEMARK OFFICE

CERTIFICATE OF CORRECTION

PATENT NO. : 9,091,995 B2
APPLICATION NO. : 14/617473
DATED : July 28, 2015
INVENTOR(S) : Shih-Chieh Huang It is certified that error appears in the above-identified patent and that said Letters Patent is hereby corrected as shown below:

Title Page, Item 73 "ASSIGNEE: GENERAL PLASTIC INDUSTRIAL CO., LTD., Taichung (TW)" should read -

ASSIGNEES: GENERAL PLASTIC INDUSTRIAL CO., LTD., Taichung (TW) and MITSUBISHI CHEMICAL CORPORATION, Tokyo (JP)

Signed and Sealed this
Twenty-fourth Day of November, 2015

Michelle K. Lee

Michelle K. Lee
*Director of the United States Patent and Trademark Office*